US005910236A

United States Patent [19]

Iossel et al.

[11] Patent Number: 5,910,236

[45] Date of Patent: Jun. 8, 1999

[54] ELECTRODES FOR ELECTRO-CHEMICAL CORROSION PROTECTION SYSTEMS

[76] Inventors: Yuri Iossel, Rahakamarinkatu 2 B 17, FI-00241 Helsinki; Grigory Kazarov, Kartanonpolku 6 B 6, FI-02360 Espoo; Veijo Koski, Aamukuja 4 G, FI-02200 Espoo; Alexey Poliakov, Punavuorenkatu 23 F, FI-00150 Helsinki, all of Finland; Heiko Gebhardt, Residence 24, rue de Mersch, L-8293 Keispelt, Luxembourg

[21] Appl. No.: 08/906,075

[22] Filed: Aug. 5, 1997

[30] Foreign Application Priority Data

Oct. 28, 1996 [RU] Russian Federation ..... 96121149

[51] Int. Cl.[6] ..... C23F 13/00

[52] U.S. Cl. ..... 204/280; 204/196.01; 204/196.1; 204/196.17; 204/196.3

[58] Field of Search ..... 204/196, 197, 204/280

[56] References Cited

U.S. PATENT DOCUMENTS

| | | | |
|---|---|---|---|
| 3,907,658 | 9/1975 | Watson | 204/197 |
| 4,175,021 | 11/1979 | Tatum et al. | 204/196 |
| 4,401,540 | 8/1983 | Tatum et al. | 204/196 |
| 4,457,821 | 7/1984 | Sudrabin et al. | 204/196 |
| 4,874,487 | 10/1989 | Reed et al. | 204/147 |
| 5,084,153 | 1/1992 | Mosse et al. | 204/228 |

FOREIGN PATENT DOCUMENTS

| | | |
|---|---|---|
| 1922151 | 11/1970 | Germany . |
| 879289 | 10/1961 | United Kingdom . |

*Primary Examiner*—Bruce F. Bell
*Attorney, Agent, or Firm*—Merchant, Gould, Smith, Edell, Welter & Schmidt

[57] ABSTRACT

An electrode for use in electro-chemical corrosion protection systems, such as cathodic and anodic metal corrosion protection, is in electric contact with a ionically conducting medium. It comprises at least two electrically non-conducting barriers, spaced apart along the electrode. Between the barriers an active part of the surface of the electrode is formed, which active part is in electric contact with the conducting medium. The barriers have a substantial extension outwards from said active part of the surface of the electrode into the conducting medium, so as to homogeneize the current distribution along said active part of the surface of the electrode. (FIG. 7A)

18 Claims, 20 Drawing Sheets

ELECTRODES FOR ELECTRO-CHEMICAL CORROSION PROTECTION SYSTEMS

TECHNICAL FIELD

The invention relates to electrodes for use in electrochemical corrosion protection systems, such as cathodic and anodic metal corrosion protection.

BACKGROUND ART, DISCUSSION OF THE PROBLEM

Electrodes for use in applications as mentioned in the introduction are used to prevent or at least to slow down corrosion processes on the surface of various metallic structures, exposed to an ionically conducting medium. They comprise an active current transferring surface, which is in electric contact with the medium and which transfers a direct current between that surface and the surface of the structure, through the medium.

The electrodes shall be designed and located in such a way that they provide a desired current distribution on the surface to be protected. In addition to requirements as to current and/or resistance, a major requirement is that they have a sufficiently long service life. Furthermore, they shall have a high operational reliability and be electrically safe.

Cathodic metal corrosion protection systems are used to prevent or at least to slow down corrosion processes on metallic structures, typically steel structures such as pipe lines and storage tanks, exposed to, in this context, a medium such as sea water and soil. The structure to be protected is made a part of an electric direct current (DC) circuit, comprising at least one electrode, which is the subject of this application. The DC current is distributed over the surface of the structure to be protected and will then give the desired effect of preventing or at least slowing down corrosion processes on the surface of the structure. Often a plurality of electrodes are used in order to improve the current distribution on the surface to be protected.

In cathodic corrosion protection systems, the electrode becomes an anode in the current circuit, that is, the current is transferred from the electrode to the structure. Basically, such systems can then operate either according to the impressed current (ICCP) principle or to the principle of a sacrificial anode.

The electrode can either be located at some distance from the structure to be protected or, in certain cases, on the surface of the structure. In both cases, the current influencing the corrosion processes is transferred between the electrode and the structure via the ionically conducting medium.

Systems operating according to the ICCP principle comprise a current source, connected between the electrode and at least one so-called drainage point at the structure via a cable. Several drainage points, spaced out on the structure, may be used. The output current of the current source is controlled in dependence on a measured voltage between the surface of the structure and a point in the medium to which it is exposed, so as to keep the protective current density at the surface at an optimum level, high enough to prevent or at least slow down the natural corrosion processes, but less than a level, where, in this case, excess hydrogen ions may appear on the structure, making the material of the structure brittle or destroy the coating (paint) on the structure. The active part of the electrode is typically made of materials with a low dissolution rate, such as silicon iron and magnetite, or titanium, coated with platinum or with mixed metal oxides.

For systems operating according to the principle of sacrificial anodes, the anode material has to be electro-positive in relation to the material of the structure to be protected. The protective current is then maintained by the electric potential difference between the two materials. Typically, such material as magnesium, zinc or aluminum are used for protection of steel structures. These materials have, however, usually higher dissolution rates than the above mentioned materials used in systems operating according to the ICCP principle. Electrodes for use as sacrificial anodes are installed either directly on the surface of the structure or at some distance from it, in which case they are connected to the structure via a feeder cable.

Typical applications of cathodic corrosion protection systems are for protection of pipelines, both against corrosion on their outer surfaces and, when they carry ionically conducting liquids, also against corrosion on their inner surfaces. Other typical application are for protection of the inner and outer surfaces of storage tanks, the inner surfaces of condensers and heat exchangers, and for armored cables, for power transmission as well as for communication purposes.

In anodic corrosion protection systems, the electrode becomes a cathode in the current circuit, that is, current is transferred from the structure to the electrode. Such systems usually operate in a way similar to the ICCP principle, however with reversed polarity of the current source. After that a first stage of operation is completed, during which a protective passivation layer is build up on the structure, the current transferred by the electrode will drop to a lower level, high enough to maintain the layer on the structure. Anodic protection systems have a more restricted use than cathodic protection systems, typically they are used for protection of structures immersed in particular media, such as for instance protection of highly alloyed steels in an acid environment with an electrode made of copper. Such applications for anodic protection systems are for example in storage tanks, in heat exchangers and in the pulp and paper industry.

FIG. 1 illustrates schematically an electrical configuration typical for a known system for cathodic corrosion protection of the outer surface of a pipeline, operating according to the ICCP principle.

A power unit 60, supplied with electric power from an alternating current supply (not shown) delivers on its output terminals 601, 602 a DC current. The terminal 601 is, via a conductor 63, connected to the outer surface of a pipeline 61 (only a part of which is shown) at a drainage point 62, and, via a feeder cable 64, to a ground bed 15.

The ground bed comprises a plurality of electrodes 16, interconnection cables 2, interconnecting the electrodes among themselves, and a backfill (not indicated in the figure), for example coke, in which the electrodes are embedded. Each of the electrodes, which are made of for example silicon iron, are electrically connected to the feeder cable.

Usually, a plurality of systems such as described in connection with FIG. 1 are distributed along the pipe line, typically with an intermediate distance in the range of 10–15 km.

FIG. 2 shows a known alternative to the electrical configuration as illustrated in FIG. 1. The structure to be protected comprises a tank 65 and a piping system 66, located under ground. In this case, the electrodes 16 are not comprised in a ground bed but are located as discrete anodes at the tank and at the piping system. The electrodes are connected to the power unit via interconnection cables 2 and feeder cables 64, FIG. 3 illustrates schematically an electrical configuration typical for a known system for cathodic corrosion protection of the outer surface of a pipe, operating according to the sacrificial anode principle. The structure to be protected is a pipe 65, located under ground. An electrode 16 is embedded in a backfill 67 and is connected to the pipe via a connection cable 68 at a drainage point 62.

FIGS. 4A–4C illustrate various prior art rod-shaped electrodes designed in an attempt to prolong their service lifetime, used for instance in corrosion protection systems operating according to the ICCP principle, for protection of the outer surfaces of pipelines and other structures. FIG. 4A shows an electrode 16 with two ends 101 and 102 and with a feeder cable 64 connected to the end 101. In the feeding end 101, the electrode has an increased diameter and is in addition protected by a sleeve 3, made of a non-conducting material. The active part of the surface of the electrode is in this case its total surface less that part of the total surface which is covered by the sleeve. FIG. 4B shows an electrode similar to the one as shown in FIG. 4A, the only difference being that it is provided with two feeder cables 64*a*, 64*b*, one at each end 101, 102 respective of the electrode, and with one sleeve 3 at each end. FIG. 4C shows a tubular electrode with a feeder cable connection 6 located at the center of it, the feeder cable connection being protected from incoming water by an insulation member 7.

FIG. 5 shows a prior art electrode for use as a sacrificial anode, for example in a configuration as illustrated in FIG. 3. The electrode is made of magnesium and comprises a steel insert 68*a* embedded in the electrode. At the feeding end 101 of the electrode, there is a recess 69 such that the cross section at the end 101 exhibits a groove in which the feeder cable 68 is connected to the steel insert via a feeder cable connection 68*b* (only indicated in the figure).

Typically, the active parts of the electrode are manufactured in the form of rods or tubular elements, which makes them easy to manufacture and to mount.

The surface of an electrode comprises an active part, which is in electric contact with the medium in which the electrode is embedded and through which the current is transferred, and often some part or parts covered with a non-conducting material, and which thus is/are not an active part of the surface of the electrode.

Dissolution of the material of the sacrificial anodes during their operation cannot be avoided and therefore an essential and basic problem with such electrodes is their limited service lifetime, which is typically much shorter than the lifetime of such structures to be protected. In order to prolong the lifetime of the electrodes, bigger sizes are often selected but still the electrodes must be replaced during their operation. Bigger anodes also have certain obvious disadvantages. For sacrificial anodes, the replacement is done typically three to five times during the lifetime of the protected structure, electrodes in systems operating according to the ICCP principle are typically renewed once or twice during that time.

For sacrificial anodes for protection of steel structures immersed in sea water, suitable electrode materials are magnesium, zinc or aluminum. A sacrificial anode of zinc or aluminum will typically lose 85 to 90% of its weight through electrolysis when the protective current to the protected structure is provided, the rest of the electrode being dissolved as a result of corrosion processes on the anode. For protection of structures embedded in soil, magnesium is typically used as electrode material, due to the lower specific conductivity of soil as compared to sea water, limiting the protective current. A sacrificial anode of magnesium has, however, a high self corrosion rate, typically up to 50%.

Another observed disadvantage of a sacrificial anode of the kind illustrated in FIG. 5 is that it starts to dissolve at the ends 101, 102, leaving the feeder cable connection and the steel insert exposed to the surrounding medium. This leads to a lower electrode voltage at the same time as the active surface of the electrode diminishes, resulting in a lower efficiency of the system.

To prolong the service lifetime of the electrode, various remedies have been proposed, as described above in connection with FIGS. 4A–4C. Thus, it has been proposed to increase the diameter of the electrode near the feeder cable connection. It has also been proposed to provide the end of the electrode with a sleeve of a non-conducting material. This measure, however, only moves the zone of dissolution to the edge of the coating. It has also been proposed to place the feeder connection at the mid of the electrode or to use two feeder connections, one at each end of the electrode. These measures have, however, only a limited effect on the service life of the electrode, achieved at the expense of more complicated and expensive designs.

Another disadvantage of such anodes which are installed directly on the structure to be protected, for use for example for protection of the inner surface of a pipeline, is that residual products, due to anodic and cathodic reaction processes, can be accumulated on the inner surface at the attachment point of the electrode, thereby making replacement of it difficult.

SUMMARY OF THE INVENTION

The object of the invention is to provide an electrode of the kind stated in the introduction, which is improved with respect to the above-mentioned disadvantages connected with the prior art, in particular the limited service lifetime connected with the rate of dissolution of the material of electrodes.

An electrode according to the invention is characterized in that it comprises at least two electrically non-conducting barriers, spaced apart along the electrode, and between which is formed an active part of the surface of the electrode, which active part is in electric contact with a ionically conducting medium, said barriers having a substantial extension outwards from said active part of the surface of the electrode into the medium, so as to homogenize the current distribution along said active part of the surface of the electrode The barriers act as barriers to the current lines at the electrode, which current lines, in the vicinity of the surfaces of the barriers, will be directed along these surfaces, and the barriers will thereby homogenize the current distribution along the active part of its surface.

A current line, as mentioned above, is to be understood as a line such that, at every point of it, the current density vector at that point is tangential to the line.

Advantageous developments and improvements of the invention will become clear from the following description and claims.

DESCRIPTION OF PREFERRED EMBODIMENTS

Electrodes operating as anodes tend to send positive ions into the surrounding medium, resulting in a dissolution of the electrode material. The dissolution rate increases with increasing current density on the electrode surface, and the electrode will gradually be dissolved, limiting its service lifetime. Usually, the feeder cable connection is located at one end of the electrode and the connection to the feeder cable may finally be broken by dissolution of the electrode. For most materials, the dissolution rate increases dramatically above certain current density levels.

Electrodes operating as cathodes can be deteriorated by incorporation of alien metal atoms/ions into the electrode material, thereby reducing the mechanical integrity of the electrodes. Also the speed of such a process increases with increasing current density.

An electrode according to the invention is characterized in that it comprises at least two electrically non-conducting barriers, spaced apart along the electrode, and between which is formed an active part of the surface of the electrode, which active part is in electric contact with the surrounding medium, said barriers having a substantial extension outwards from said active part of the surface of the electrode into the medium. As will be further explained below, the barriers act as barriers to the current lines at the electrode, which current lines, in the vicinity of the surfaces of the barriers, will be directed along these surfaces, and will homogenize the current distribution along the active part of the surface of the electrode.

Figure 6A:
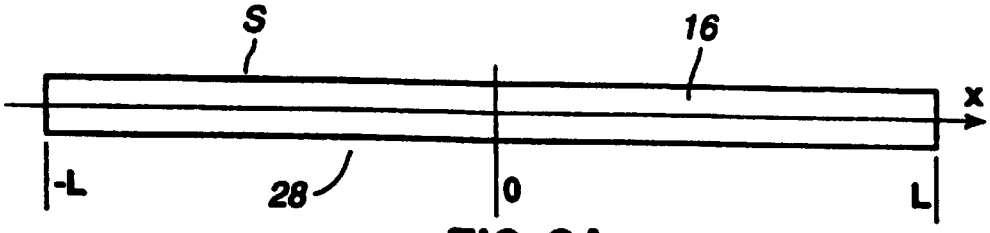
FIG. 6A (PRIOR ART)
FIG. 6A shows a prior art cylinder-shaped electrode.

FIG. 6A shows a conventional cylinder-shaped electrode 16 of a highly conducting material. The electrode is embedded in a surrounding conducting medium 28, such as sea water or soil (only indicated in the figure), with a specific conductivity several orders of magnitude below the specific conductivity of the material of the electrode, and also assumed to transfer a current to the medium. The length of the electrode is 2 L and the envelope surface S of it constitutes the active part of its surface.

In the specific examples illustrated below, the cylinder is 1 m long and has a diameter of 3 cm.

Figure 6B:
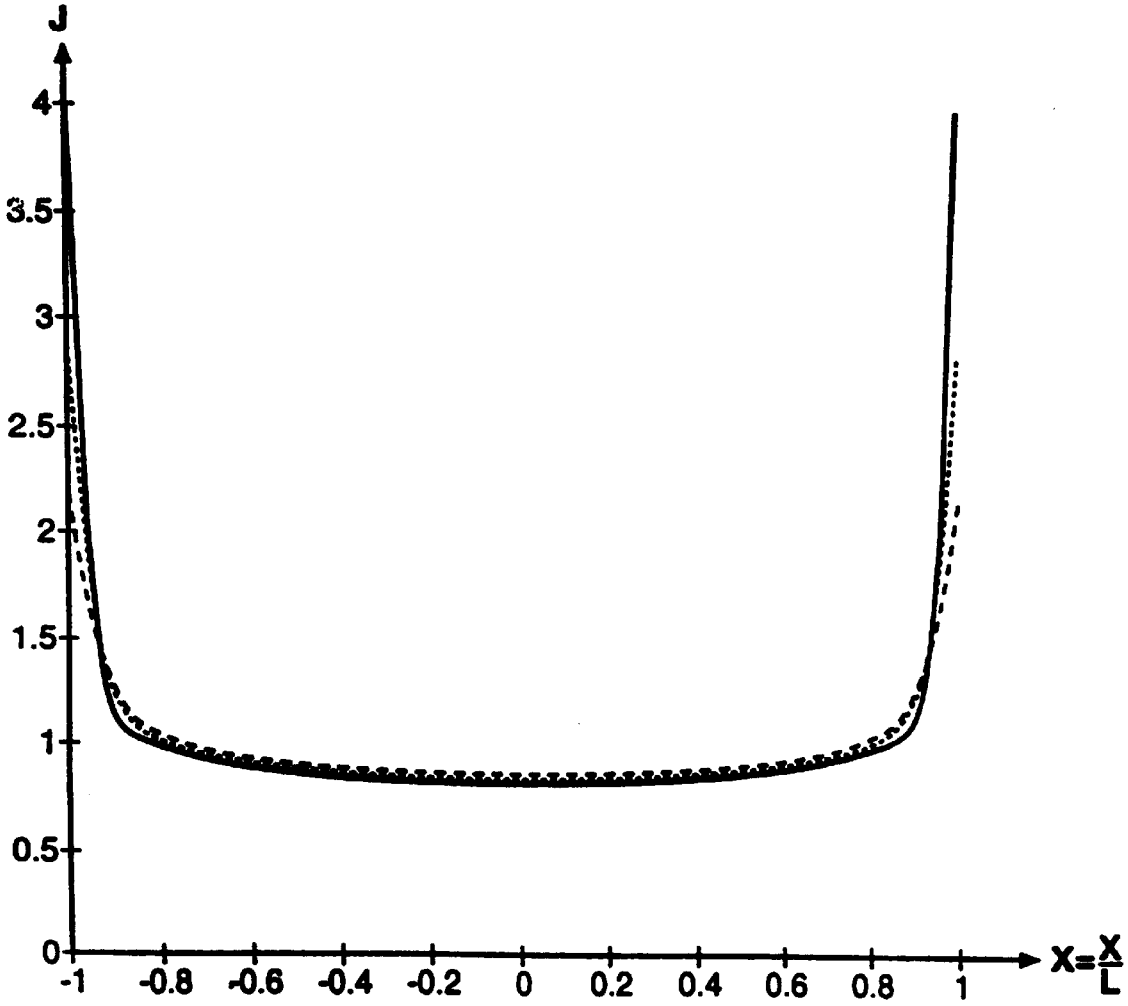
FIG. 6B (PRIOR ART)
FIG. 6B shows the current distribution along an electrode according to FIG. 6A, embedded in sea water.

FIG. 6B shows on the vertical axis the normalized local current density J(x)/Javg at the surface of the electrode, where J(x) is the actual current density at a relative distance x/L along the electrode from the mid of it, and Javg is the average value of the current density along the electrode. The horizontal axis shows the relative distance x/L with positive direction to the right in the figure. It is known that the current distribution is dependent on the so called specific anodic polarization resistivity $b_a$. The diagram shows the normalized current density as a function of the relative distance for three different values of specific polarization resistivities $b_a$, in the range between 0.02 $\Omega*m^2$ to 0.08 $\Omega*m^2$, $b_a$=0.02 $\Omega*m^2$ (whole line) representative for silicon iron, $b_a$=0.04 $\Omega*m^2$ (short-dashed line) representative for graphite and $b_a$=0.08 $\Omega*m^2$ (long-dashed line) representative for magnetite, under the assumption that the mentioned materials are in contact with sea water.

Figure 6C:
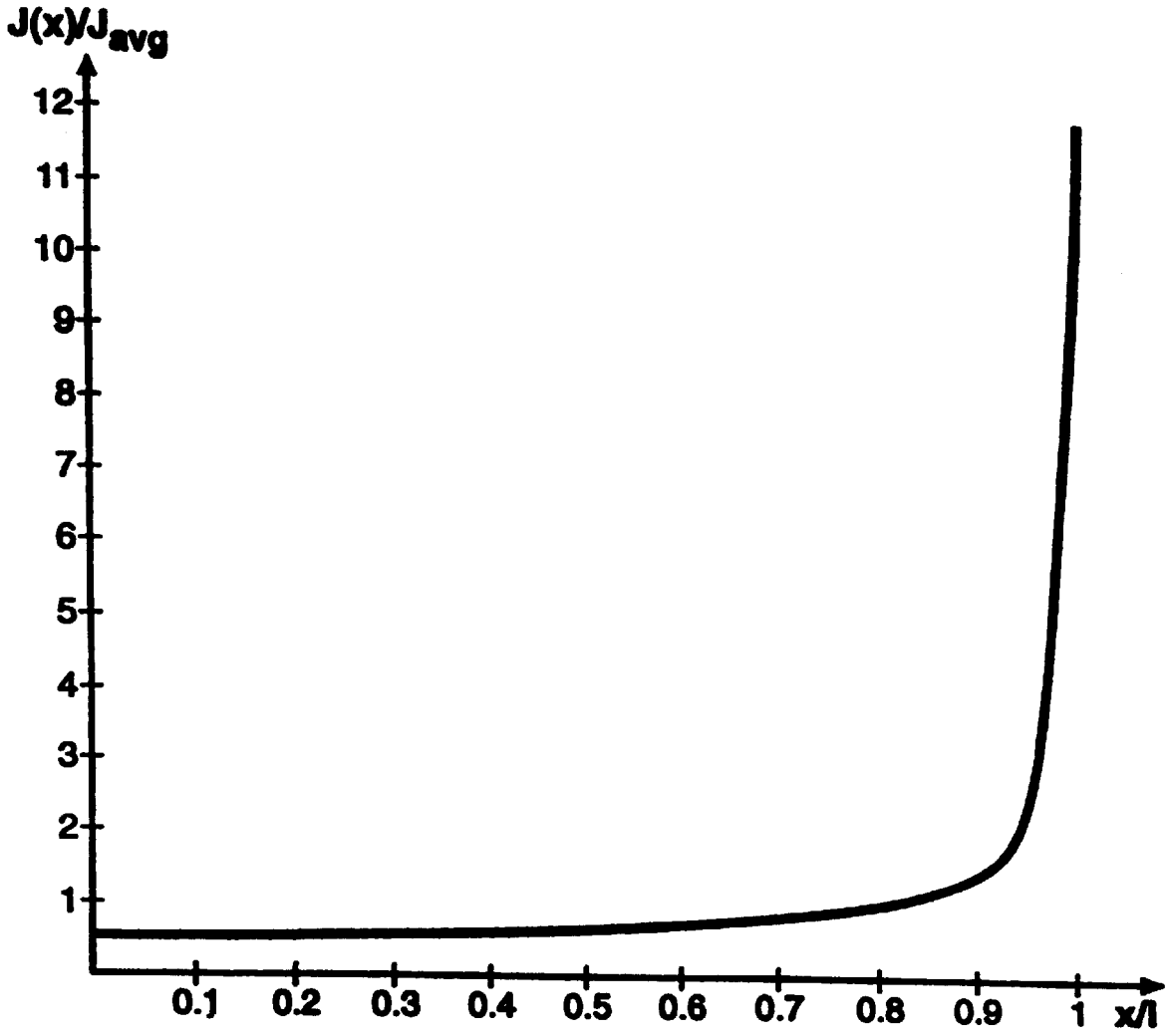
FIG. 6C (PRIOR ART)
FIG. 6C shows the current distribution along an electrode according to FIG. 6A, embedded in soil.

FIG. 6C shows on the horizontal axis the same entity as the horizontal axis in FIG. 6B, and on the vertical axis the calculated normalized local current density J(x)/Javg at the surface of a cylinder-shaped electrode such as described in connection with FIG. 6A, for the case that the electrode is made of silicon iron and embedded in soil with a specific electric resistivity of 50 ohm *m.

The FIGS. 6B–6C show that the normalized current density increases rapidly in the neighborhood of the ends of the electrode.

Figure 7A:
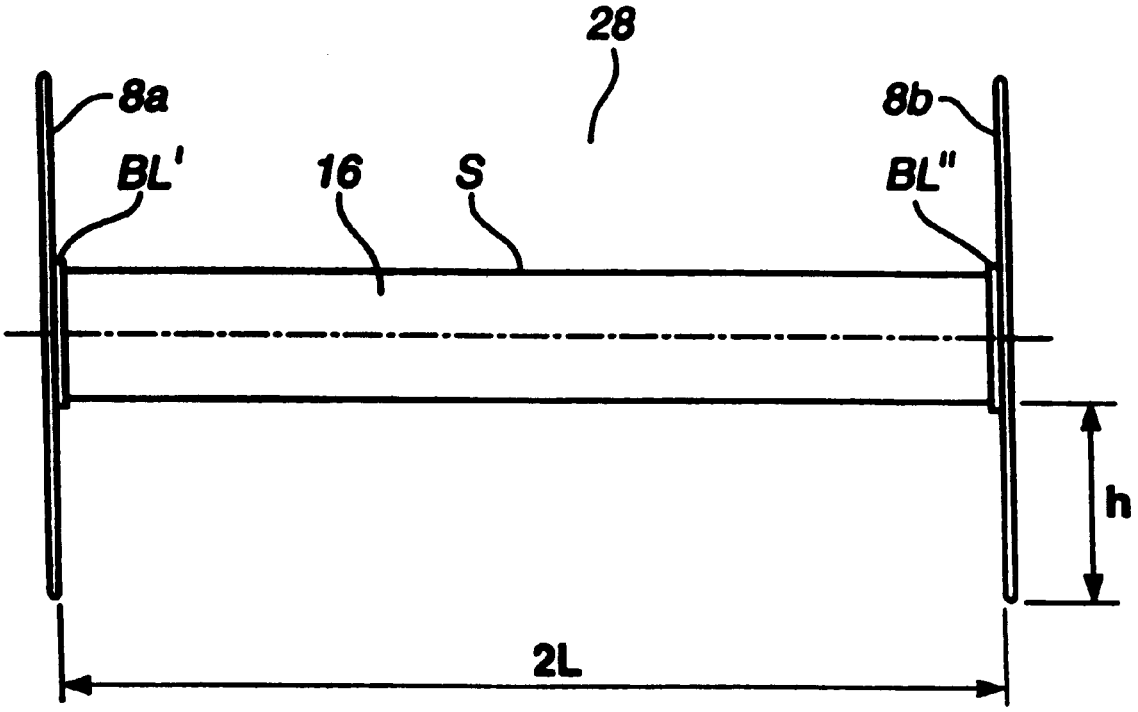
FIG. 7A shows an embodiment of a cylinder-shaped electrode, provided with non-conducting barriers according to the invention.

FIG. 7A shows schematically an electrode 16 of the same kind as described in connection with FIG. 6A and embedded in a medium 28 with similar properties. The electrode is, according to the invention, equipped with two barriers 8*a*, 8*b*, one at each end. The barriers are made of a non-conducting material, chosen such that they maintain their non-conducting properties during the service lifetime of the electrode, for instance polyethylene or polypropylene. They have the shape of circular discs, with their plane perpendicular to the electrode. The radius of the barriers is such that their circumferences extend with a distance h outwards from the envelope surface of the cylinder. The border lines BL', BL" of the active part S of the surface of the electrode are in this case the lines along which the envelope surface of the electrode adjoins the respective barriers.

The effect of the barriers on the current distribution along the active part of the electrode surface is to homogenize the current distribution. The barriers act as barriers to the current lines, which, in the vicinity of the surfaces of the barriers, will be directed along these surfaces. Thus, the barriers homogenize the current distribution along the electrode.

Figure 7B:
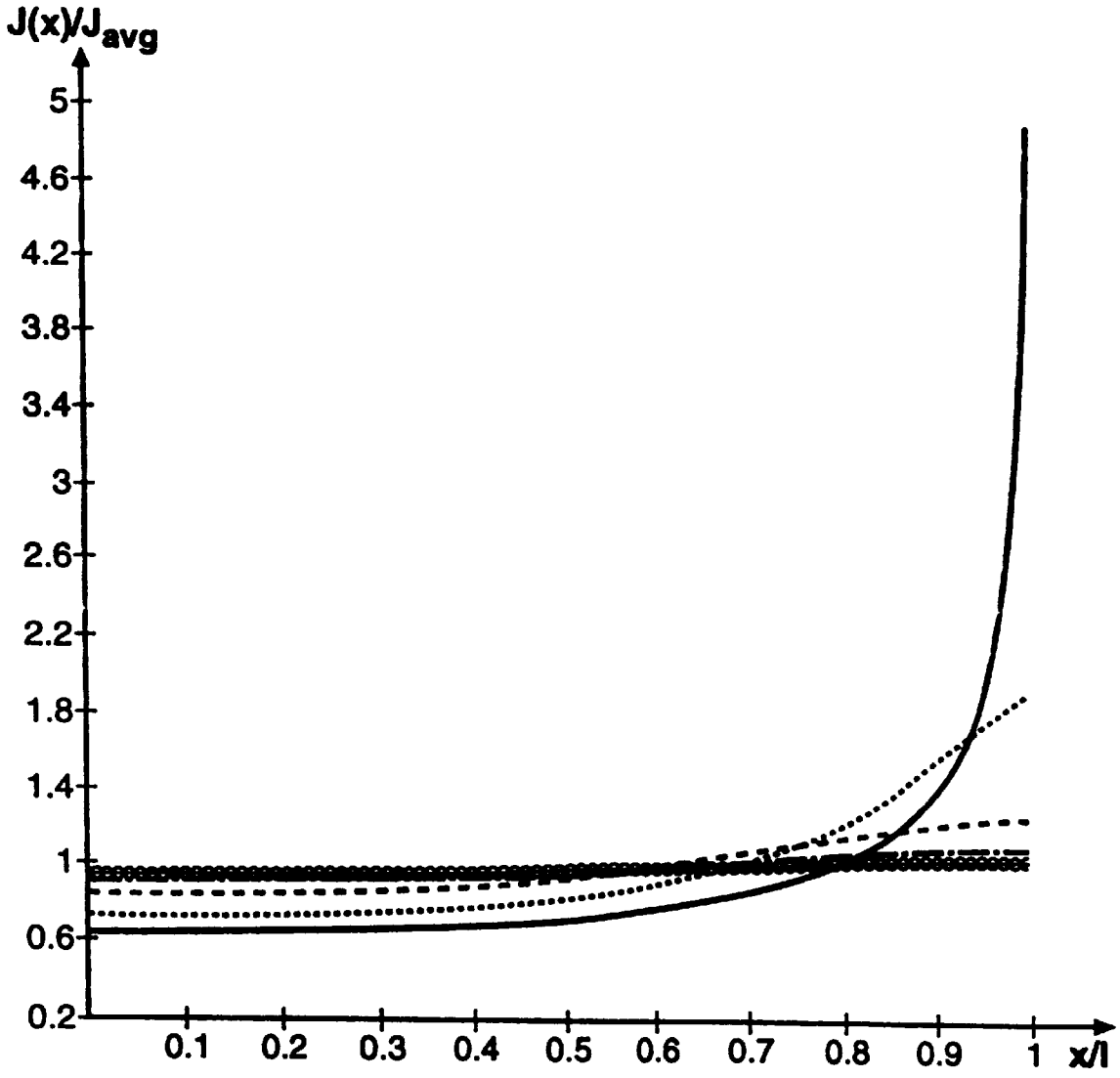
FIG. 7B illustrates the homogenizing effect of non-conducting barriers according to FIG. 7A, on the current distribution along a cylinder-shaped electrode embedded in sea water.

FIG. 7B shows on the horizontal and on the vertical axis the same entities as FIG. 6B, for an electrode according to FIG. 7A. The diagram is calculated for an electrode embedded in sea water. The ratio J(x)/Javg is calculated for a specific polarization resistivity $b_a$=0.02 Ω*$m^2$ and the short-dashed line shows the homogenizing effect of a barriers with a ratio h/L=0.1, the long-dashed line with a ratio h/L=0.3, the point-dashed line with a ratio h/L=0.5, and the line with circles on it with a ratio h/L=0.7. For a comparison, the same ratio is plotted as a whole line for a similar electrode but without barriers.

Figure 7C:
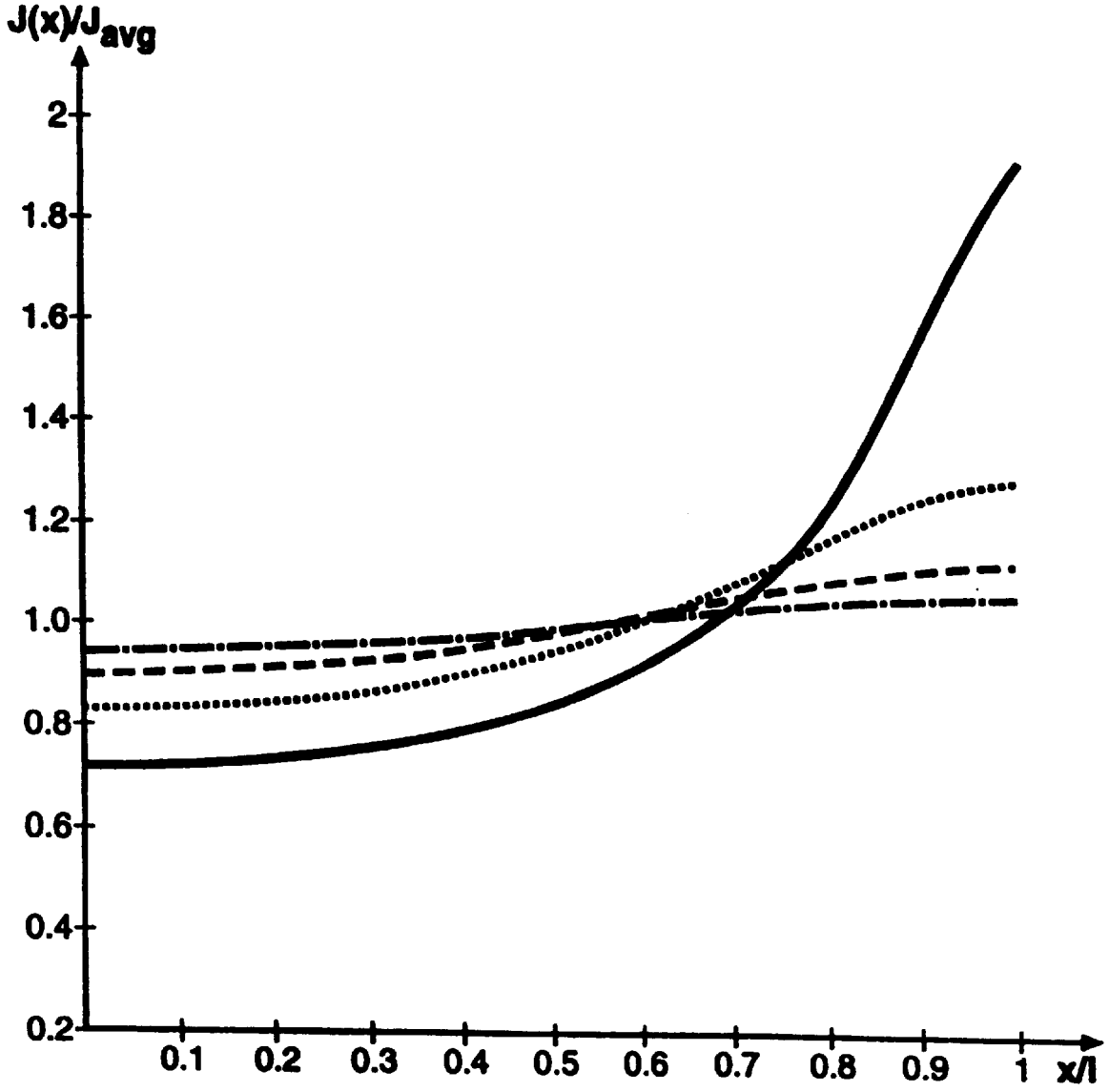
FIG. 7C illustrates the homogenizing effect of non-conducting barriers according to FIG. 7A, on the current distribution along a cylinder-shaped electrode embedded in soil.

FIG. 7C shows on the horizontal and on the vertical axis the same entities as FIG. 7B, for an electrode according to FIG. 7A. It is in this case assumed that the electrode is embedded in soil with a specific electric resistivity of 50 ohm *m.

The diagram shows the homogenizing effect of the barriers with a ratio h/L=0.1 (the whole line), with a ratio h/L=0.3 (the dotted line), with a ratio h/L=0.5 (the dashed line), and with a ratio h/L=0.7 (the point-dashed line).

As can be seen in the FIGS. 7B–7C, already for a ratio h/L=0.5, the maximum current density, at any point at the surface of the electrode, will be only about 12–14% higher than the average current density, which for most practical purposes is a sufficient value.

In certain cases, especially for long electrodes, a plurality of barriers, spaced along the whole electrode, can be used to obtain the desired homogenizing effect. The same effect as described above is then achieved for each part of the electrode located between two adjacent barriers, spaced along the cylinder with the distance 2 L between them, and with each barrier having the height ratio h/L. Studies have shown that an overall optimized homogenizing effect for an electrode can be achieved with different distances between pairs of adjacent barriers.

Substantially, the same homogenizing effect can be achieved also with barriers and electrodes with different geometries. Thus, the barriers as described in connection with FIG. 7A must not necessarily be in the shape of circular discs, but could also be in the shape of plates with, for example, a rectangular or quadratic form, for instance such as is illustrated in the FIG. 9 described below. Also as an example, for a cylindrical electrode, the barriers could exhibit a convex surface towards that part of the electrode on which the homogenizing effect is desired. However, the homogenizing effect achieved will depend on the dimensions of the barriers as projected on a plane substantially perpendicular to the active part of the surface of the electrode, as well as on the shape of the barriers.

In case the electrode has a flat shape, the barriers could preferably be given the shape of a plate, adapted to the dimensions of the electrode.

Thus, with electrodes provided with barriers according to the invention, a more homogeneous current distribution along the active surface of the electrode can be achieved. The negative effects of local high current density, such as low utilization of the electrode and enhanced local electrode dissolution, are then substantially reduced.

Figure 7D:
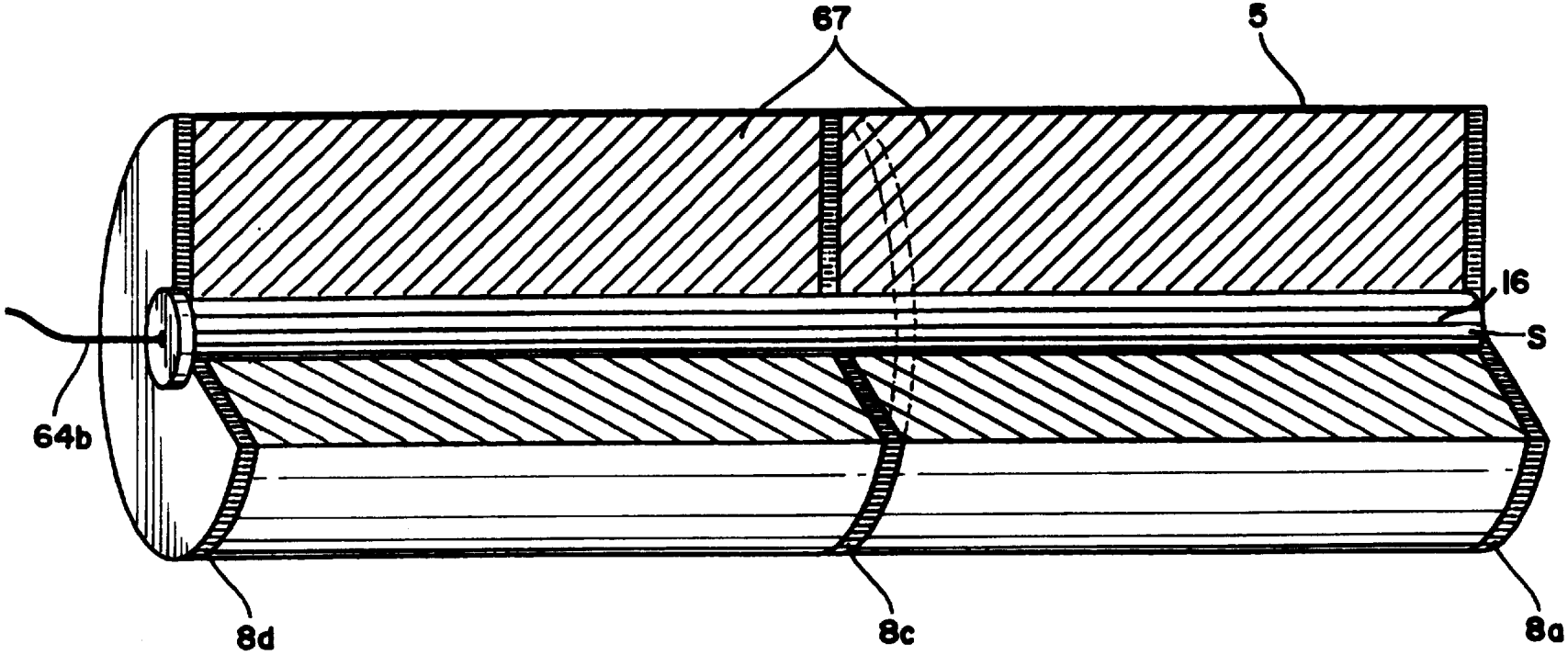
FIG. 7D illustrates a development of the invention according to FIG. 7A, wherein the electrode is enclosed by a cylindrical metal tube.

The electrodes are often made of a brittle material, such as silicon iron, graphite or magnetite. A development of the invention is illustrated in FIG. 7D. The figure shows schematically a cut-up view of an electrode 16 of the same kind as described in connection with FIG. 7A, provided with a feeder cable 64*b*, two barriers 8*a*, 8*b*, one at each end of the electrode, and a third barrier 8*c* located in between these barriers. The barriers are of the same kind as described in connection with FIG. 7A. According to this development of the invention, a cylindrical metal tube 5, for example made of steel, encloses the electrode so as to form together with the two end barriers 8*a*, 8*c*, a closed canister containing the electrode. The canister is filled with a backfill 67, for example of coke. In this way, a mechanically robust package is achieved, which can easily be embedded in the groundbed. The homogenizing effect of the barriers on the current distribution at the electrode, will, with an arrangement according to FIG. 7D, be similar or, at least temporarily, even better than as described in connection with FIGS. 7A–7C. When the electrode is put into operation, the current distribution along the electrode will initially be quite even, as the arrangement will behave like a cylindrical capacitor. The metal tube will then, in course of time, gradually dissolve, starting at the parts closest to the barriers 8*a* and 8*b*, where the current density at the metal tube is highest. In a transition phase, where the ends of the remaining part of the metal tube no longer touches the barriers 8*a*, 8*b*, that remaining part, which surrounds the electrode, may still contribute to the homogenization of the current distribution at the electrode, as it usually has a specific resistivity which is lower than the specific resistivity of the backfill. Finally, the metal tube is completely dissolved and the barriers will influence the current distribution as described in connection with FIGS. 7A–7C.

Figure 7E:
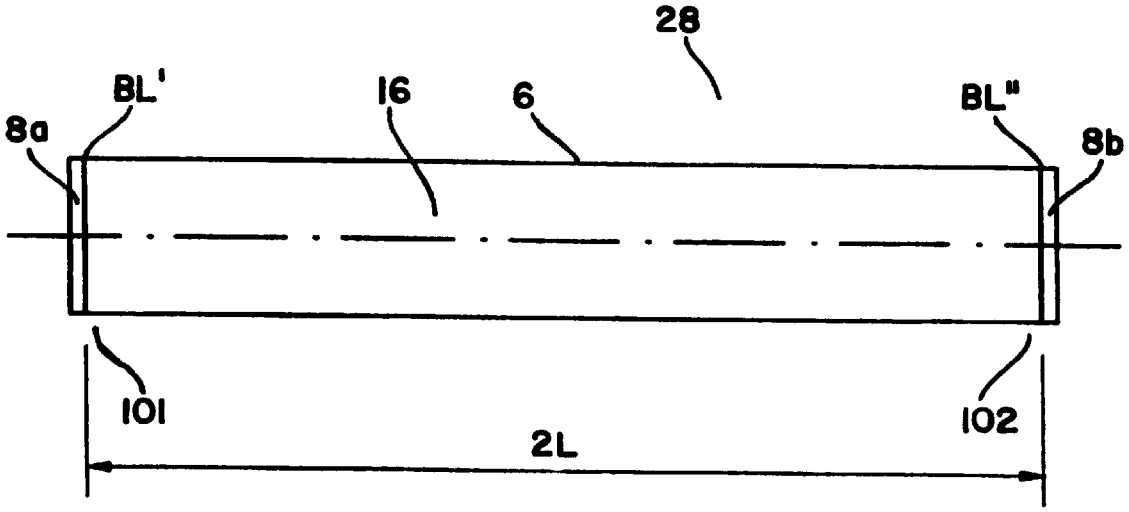
FIG. 7E illustrates an alternative embodiment of the invention.

An alternative embodiment of the invention is illustrated in FIG. 7E. The barriers 8*a*, 8*b* have in this case substantially the same diameter, that is the same cross-section dimension, as the original diameter of the electrode 16. When the electrode is put into operation, an electrode dissolution process as mentioned above may start, in particular at the border lines BL' and BL" of the active part of the surface of the electrode. As is understood from above, the homogenizing effect of the barriers will, during this process, gradually influence the current distribution along the active part of electrode, so as to achieve a more homogeneous current distribution along the active part of the surface of the electrode. Eventually, an equilibrium state is reached, wherein, at the ends 101, 102 of the electrode, the diameters of the barriers are greater than the diameters of the still undissolved electrode, and wherein the surface of the undissolved electrode exhibits an acute angle with the plane of the barriers. The dissolution process will then come to an end or at least slow down to a very low rate, and the effect of the barriers will become similar to the one described in connection with FIGS. 7A–7C. In this alternative embodiment, the embedding of the electrode in the ground bed 15 is facilitated, although a certain amount of electrode material will be dissolved before the effect of the barriers will be fully developed.

Figure 8:
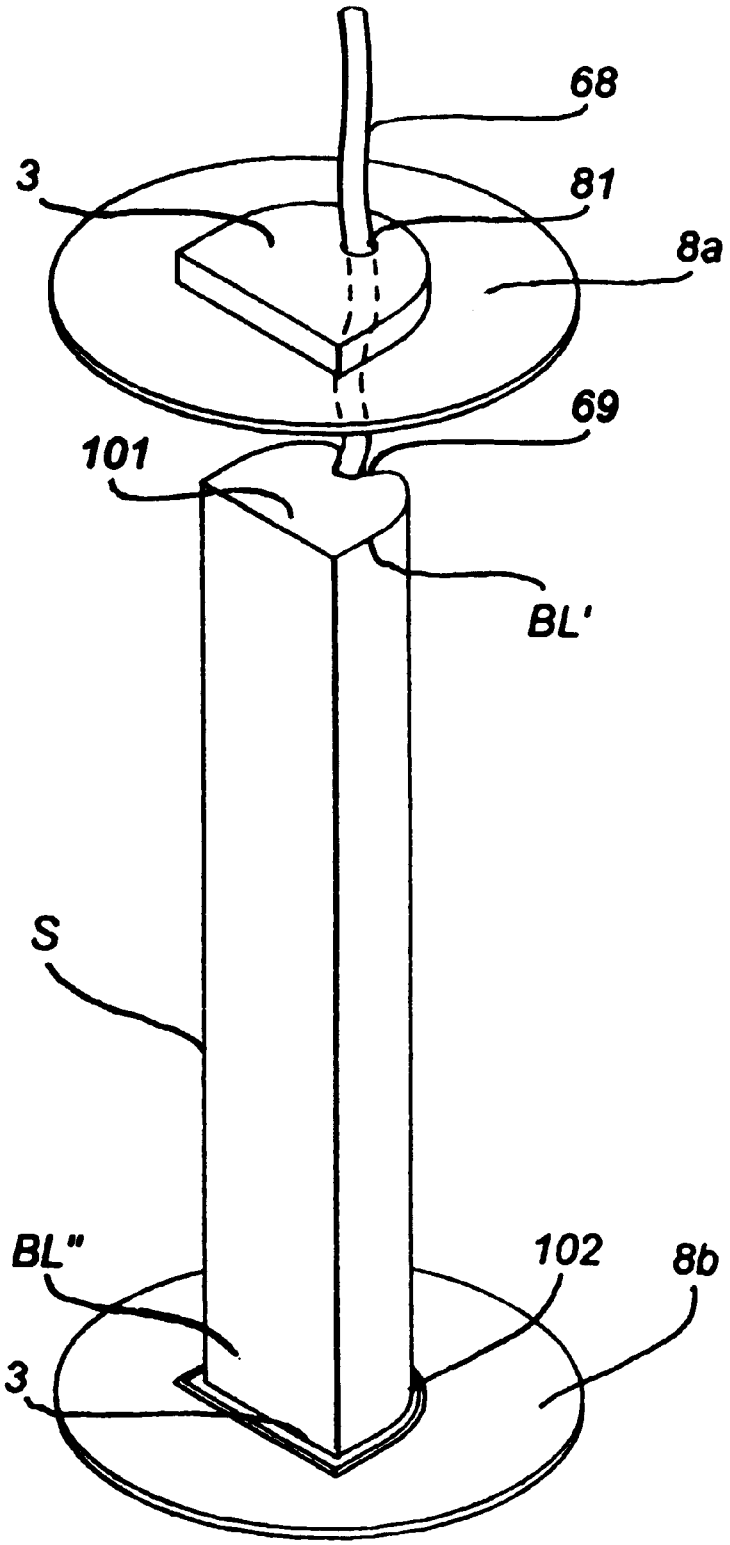
FIG. 8 shows in an exploded view an embodiment of an electrode according to FIG. 5, provided with non-conducting barriers according to the invention.

Another embodiment of the invention is illustrated in FIG. 8 shows in an exploded view an embodiment of an electrode 16 for use as a sacrificial anode, similar to the one described in connection with FIG. 5 (the same reference numbers refers to the same parts in both figures), but provided with two barriers 8*a*, 8*b* according to the invention, one at each end. The barriers are in the shape of circular discs. The barriers are provided with sleeves 3 (shown only at the barrier located at the end 102 of the electrode) of non-conducting material to facilitate mounting of the barriers on the electrode. The barrier located at the end 101 of the electrode is provided with a hole 81 through which the feeder cable passes. For the sake of clarity of the figure, the barrier 8*a* is shown moved away from its normal location at the end 101 of the electrode. In mounted position, the border lines BL', BL" of the active part S of the surface of the electrode are in this case the lines along which the envelope surface of the electrode adjoins the respective sleeves of the barriers.

Figure 1:
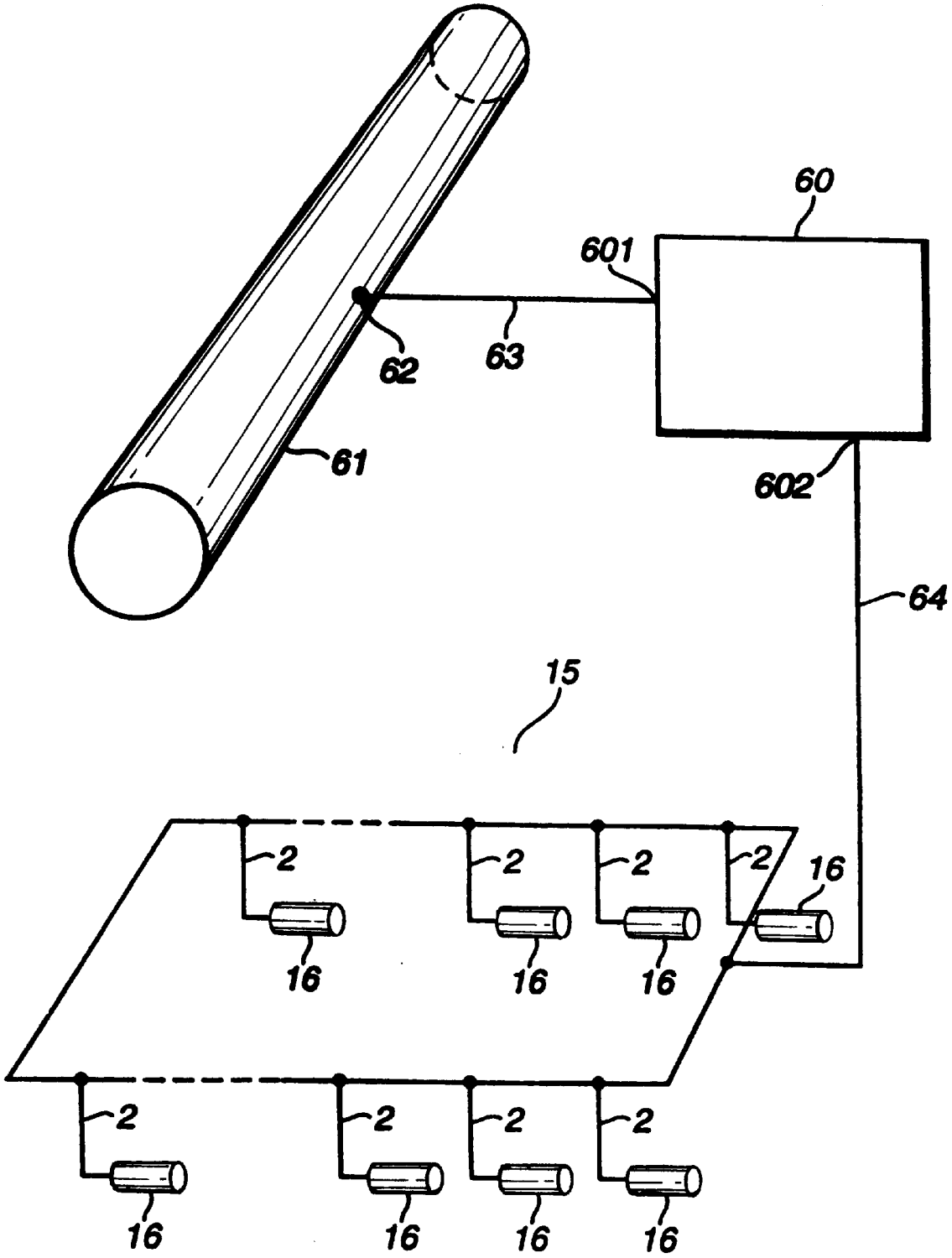
FIG. 1 (PRIOR ART)
FIG. 1 shows schematically an example of a prior art system for cathodic corrosion protection with a ground bed.
Figure 2:
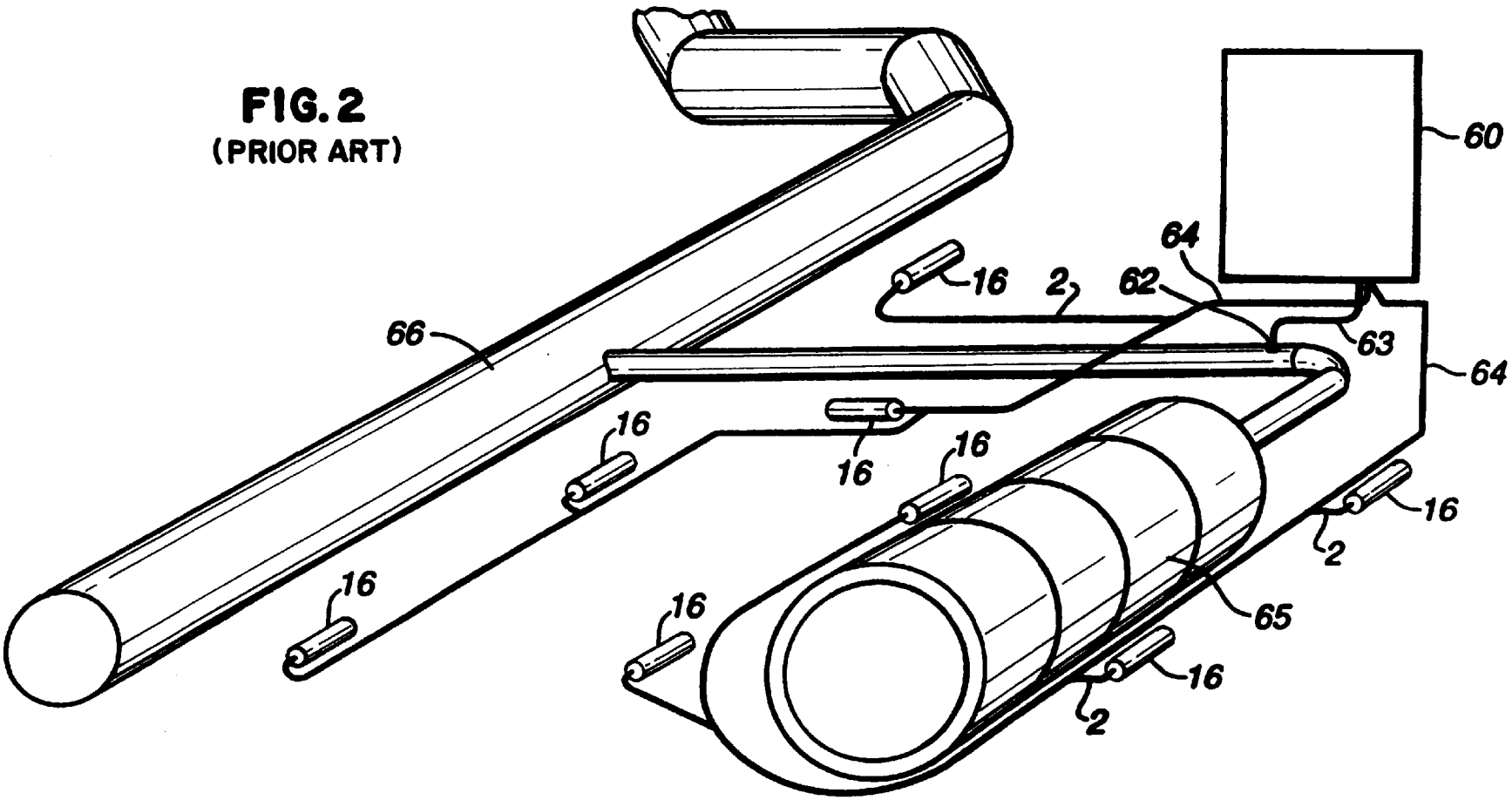
FIG. 2 (PRIOR ART)
FIG. 2 shows an example of a prior art system for cathodic corrosion protection with discrete electrodes.
Figure 3:
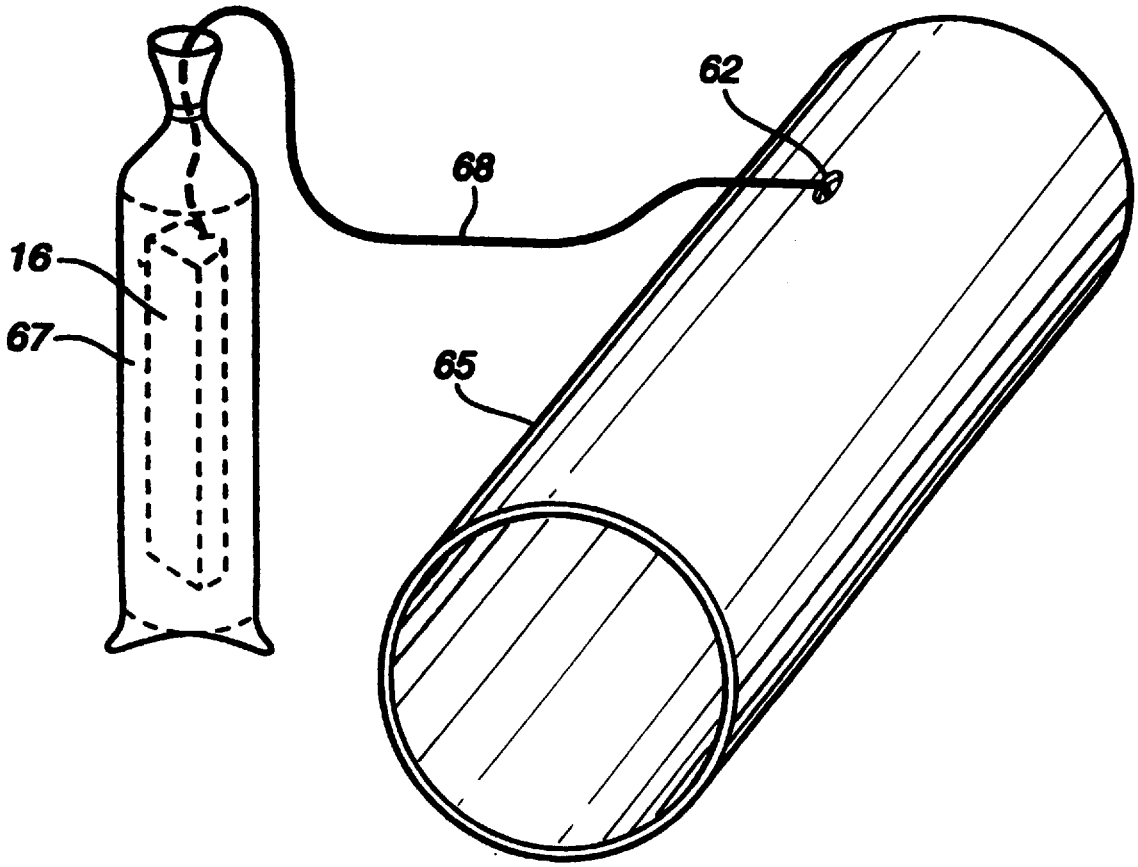
FIG. 3 (PRIOR ART)
FIG. 3 shows an example of a prior art system for cathodic corrosion protection with a sacrificial anode.
Figure 4A:
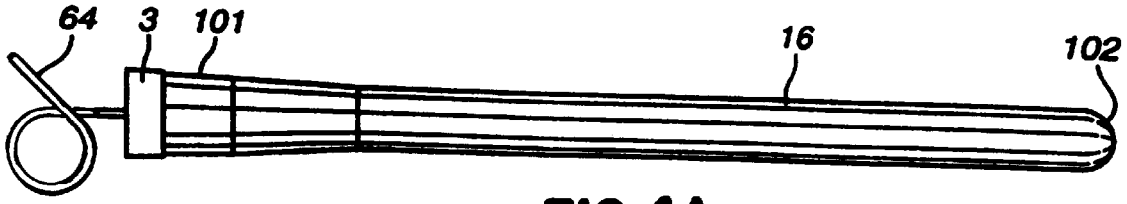
FIG. 4A (PRIOR ART)
FIGS. 4A–4C show various prior art electrodes for use in systems operating according to the ICCP principle.
Figure 4B:
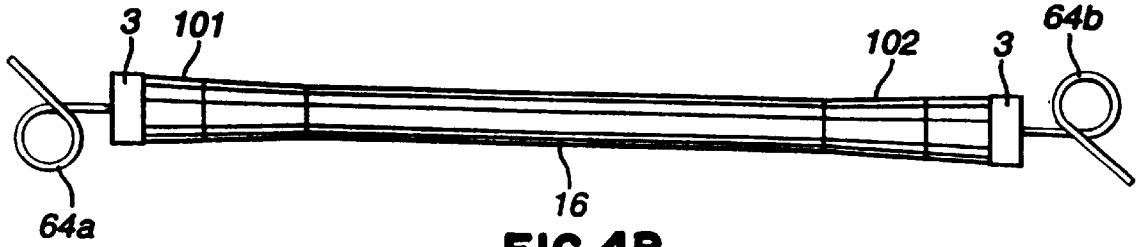
FIG. 4B (PRIOR ART)
Figure 4C:
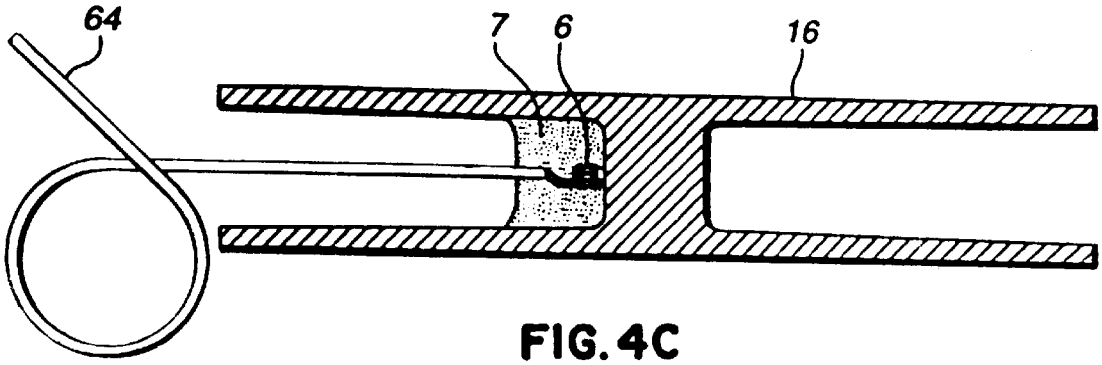
FIG. 4C (PRIOR ART)
Figure 9:
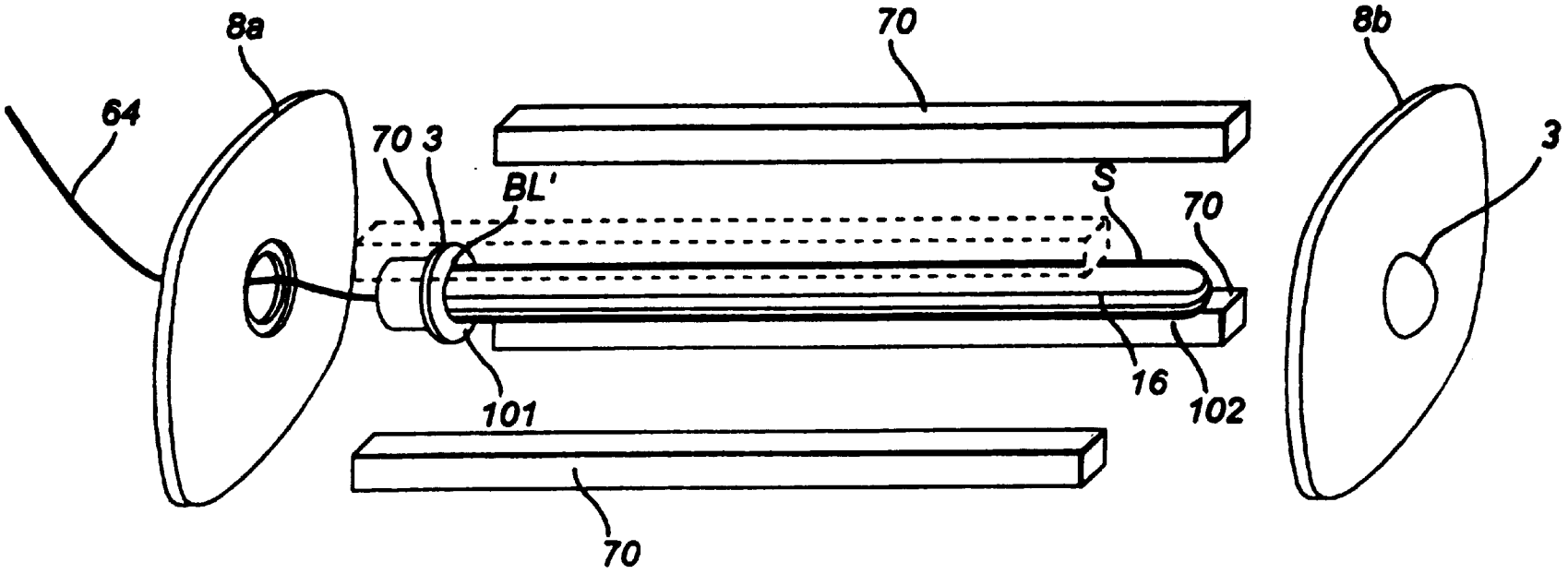
FIG. 9 shows in an exploded view an embodiment of an electrode according to the invention, for use in a system operating according to the ICCP principle.

FIG. 9 shows in an exploded view an embodiment of an electrode for use in a system operating according to the ICCP principle. The electrode is similar to the one described in connection with FIG. 4A (the same reference numbers refers to the same parts in both figures), but of cylindrical shape and provided with two barriers 8*a*, 8*b* according to the invention, one at each end. The barriers are in the shape of rectangular plates with rounded corners and provided with sleeves 3 or a non-conducting material, as described in connection with FIG. 8, serving as mechanical supports for the barriers when they are mounted on the electrode. The electrode, the two barriers and four wooden supports 70 (of which only three are shown in the figure) are mounted together, in a manner known per se, to form one unit, so that the barriers serve as mechanical supports for the electrode. In the mounted unit, the two barriers are located at the ends of the cylindrical electrode, projecting from it in a direction perpendicular to the active part of its surface, which active part is the part not covered by the two sleeves 3 (and the barriers in mounted position). In the mounted unit, the border lines BL', BL" (only BL' is shown in the figure) of the active part S of the surface of the electrode are in this case the lines along which the envelope surface of the electrode adjoins the respective sleeves of the barriers, that is, at the edges of the sleeves facing the active part of the surface.

Theoretically, the barriers shall preferably be located at these border lines, but for practical purposes, a sufficiently homogenizing effect on the current distribution is achieved also when the barriers, for instance for mechanical design reasons as described above in connection with FIGS. 8 and 9, are displaced from these border lines along the longitudinal direction of the electrode. However, the displacement of the barriers from the mentioned border lines shall preferably be small in relation to the dimensions of the barriers in a plane perpendicular to the active part of the surface, so that the barriers are located at or close to these border lines, the wording 'close to' to be understood as so close that the desired homogenizing effect of the barriers is achieved. To achieve a good homogenizing effect, it is also preferable that the barriers, at least at the surface of the electrode, shall project in a direction which is substantially perpendicular to the active part of the surface of the electrode.

Also, theoretically, it is preferable that the barriers, at least at the surface of the electrode, shall project in a direction which is substantially perpendicular to the active part of the surface of the electrode. However, for practical purposes, also an embodiment of the invention where, for example, the barriers exhibit a convex surface towards that part of the electrode on which the homogenizing effect is desired, can be designed to achieve the desired homogenizing effect, provided the dimensions of the barriers as projected on a plane substantially perpendicular to the active part of the surface of the electrode are made sufficiently large.

Figure 10:
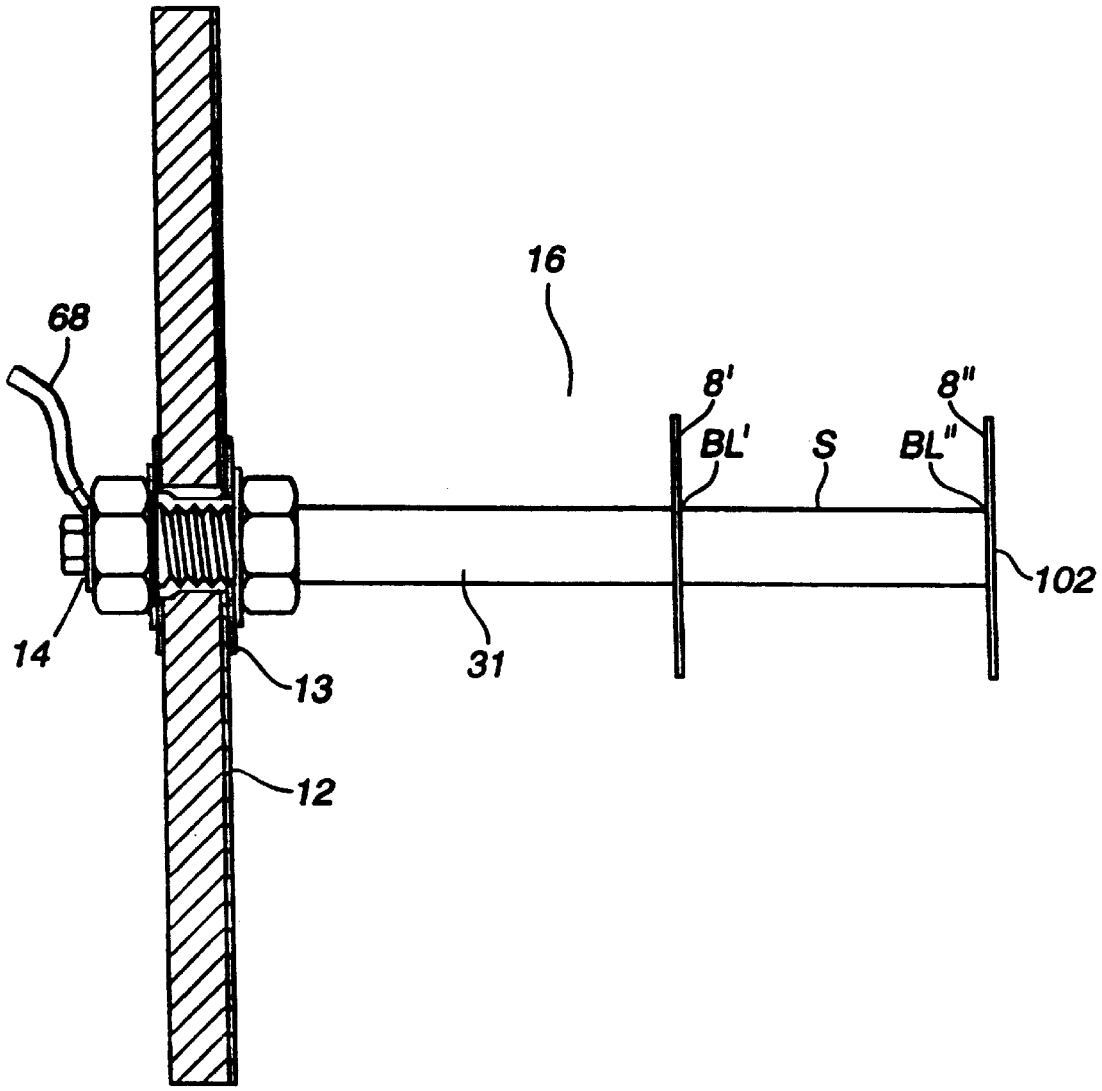
FIG. 10 shows an embodiment of an electrode according to the invention, for use in a system for cathodic corrosion protection operating according to the ICCP principle, for protection of the inner surface of a structure.

FIG. 10 shows an electrode 16 according to the invention, for use as an anode in a system for cathodic corrosion protection operating according to the ICCP principle, for protection of the inner surface of a structure 12, for instance a heat exchanger or a pipeline. The material of the electrode is for instance of titanium coated with platinum. The electrode is of cylindrical shape and mounted on the structure 12 with an attachment member 13, providing a water tight and from the structure electrically insulating mounting of the electrode. The electrode is connected to a feeder cable (not shown) via a cable connector 14. The electrode is provided with a barrier 8' located, along the electrode, at some distance from the attachment member 13 and a barrier 8", located at the end 102 of the electrode which is opposite to the attachment member. A sleeve 31 of a non-conducting material covers that part of the electrode surface which is located between the attachment member and the barrier 8' and provides an electric isolation of the electrode from the medium along its extension between the inner surface of the structure and the barrier 8'. The active part S of the surface of the electrode body is in this case that part of the envelope surface of the electrode which is not covered by the sleeve and is limited by the border lines BL', BL" along which the envelope surface of the electrode adjoins the barriers 8', 8" respectively.

With an electrode as here described, a high current density at the protected structure in the vicinity of the electrode attachment member is avoided due to the effect of the sleeve 31. The current density distribution along the electrode is homogenized by the barriers 8, 8', thereby avoiding a high dissolution rate which would otherwise be the case, due to high current densities in particular at the edge of the sleeve and at the end 102 of the electrode. Thus, the dissolution rate along the active part S of the surface of the electrode will be kept substantially constant, resulting in an increased lifetime of the electrode. Preferably, the barriers are made of a flexible material, to facilitate mounting of the electrode through a hole in the wall of the structure to be protected.

If necessary for reaching the desired homogenizing effect, in particular in cases where the space available in a direction perpendicular to the longitudinal direction of the electrode is restricted, one or more additional barriers can be placed along the electrode in between the shown barriers 8', 8".

Figure 11A:
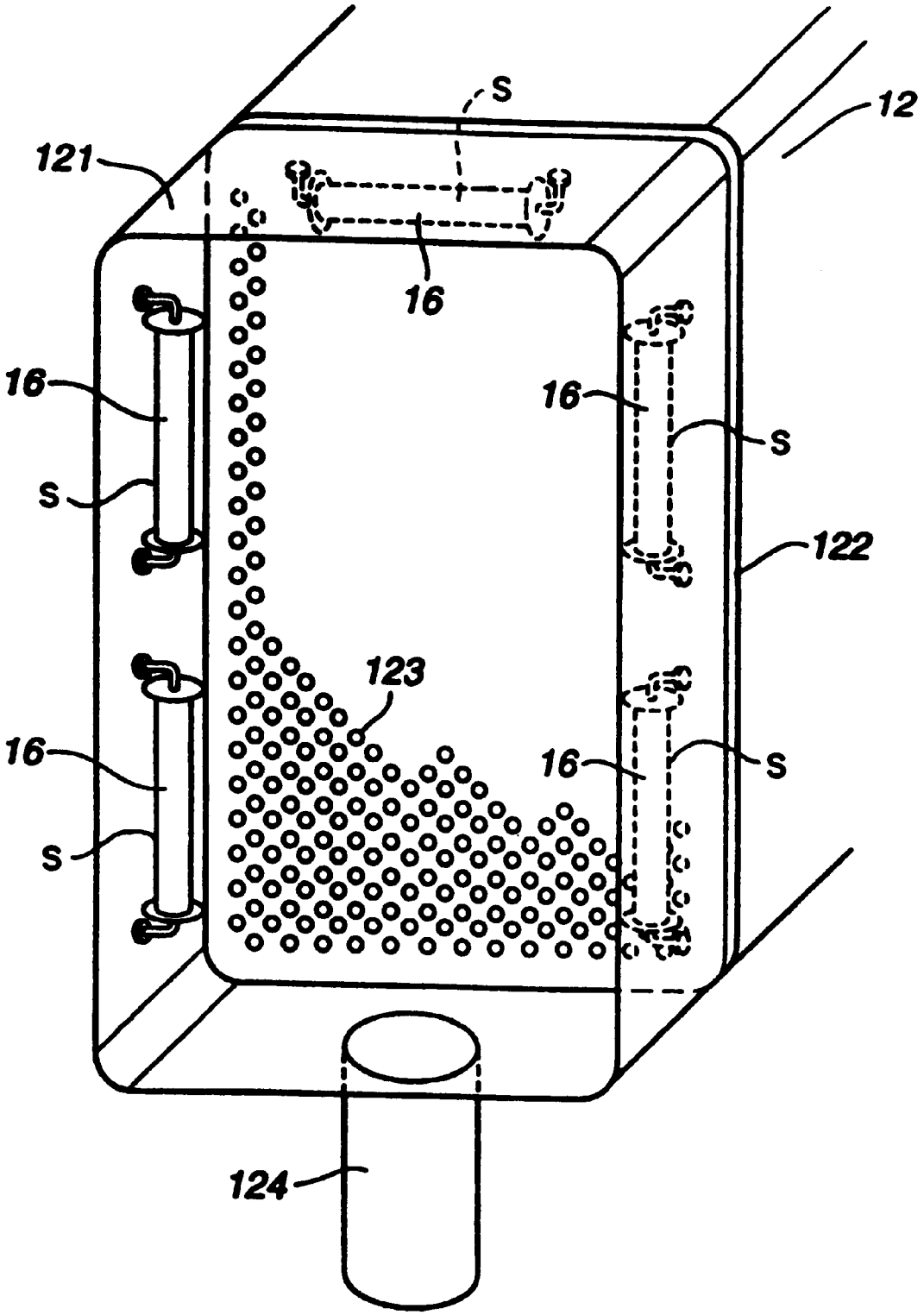
FIG. 11A shows schematically an embodiment of a cathodic protection system for protection of a condenser, with electrodes according to the invention.
Figure 11B:
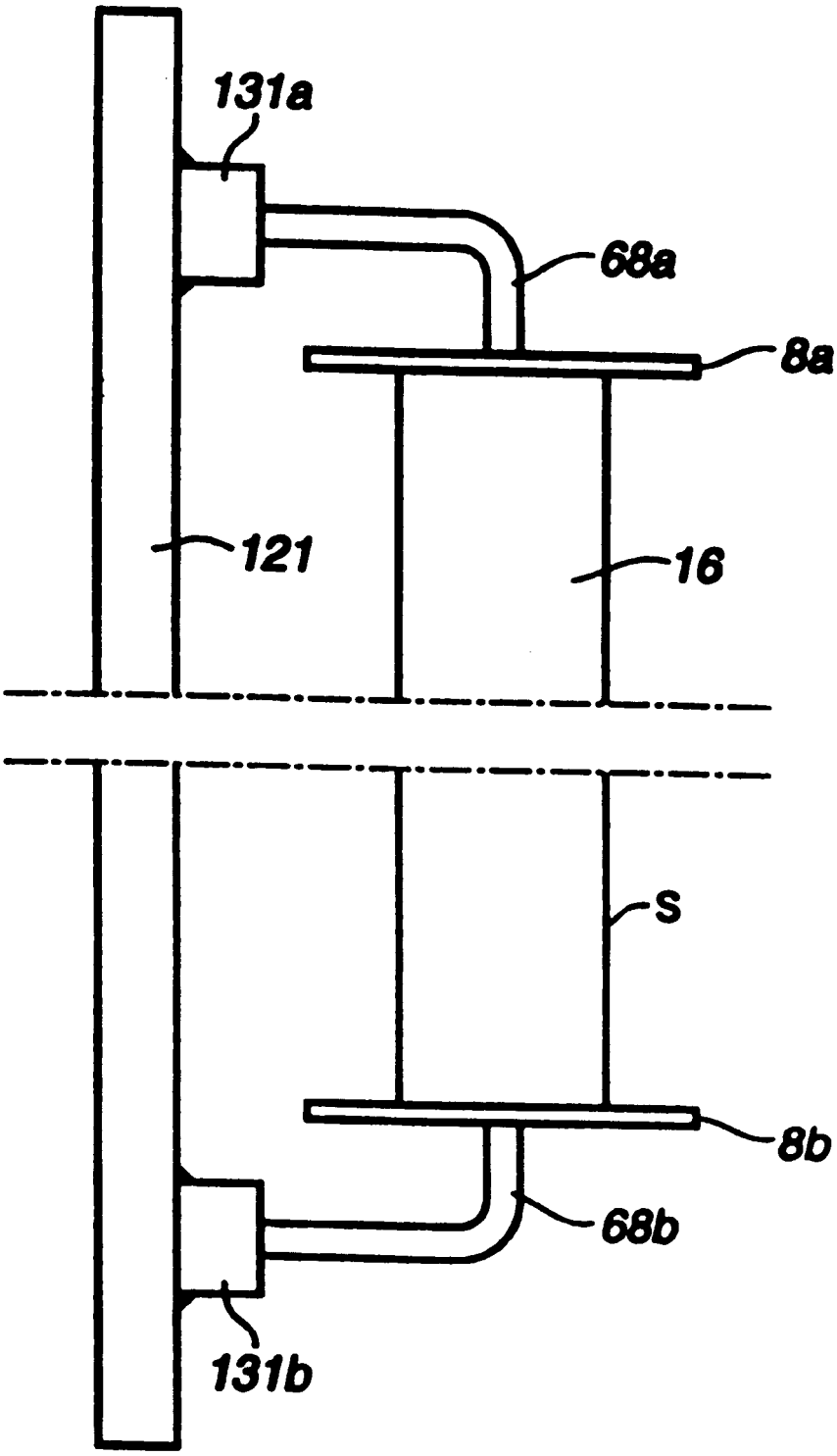
FIG. 11B shows details of an electrode for use in a system according to FIG. 11A.

FIG. 11A shows schematically a condenser (heat exchanger) 12 with a water chamber 121 and tube plates 122, only one of which is shown. Tubes, kept in place by the tube plates, are indicated with the reference number 123. The water chamber has a water inlet 124. The inner wall of the water chamber and the tube plates are provided with electrodes 16 according to the invention, operating as sacrificial anodes. FIG. 11B shows details of such an electrode, for protection of the inner surface of the water chamber. The electrode 16 is from both ends, via connector bars 68*a*, 68*b*, connected to the inner surface of the water chamber 121. The connection bars are mechanically designed to carry and to hold the electrode in its position in the water chamber. At the walls of the water chamber, attachment members 131*a*, 131*b* respectively, provide an electrically conducting mechanical attachment of the connection bars to the walls. The electrode is provided with barriers 8*a*, 8*b* according to the invention. The electrodes for protection of the tube plates are of similar design.

A pipe system (not shown) in communication with the water chamber and attached to the water inlet 124, may be protected with its own cathodic corrosion protection system.

With a more homogeneous current distribution along the active part of the electrode surface, the dissolution rate of the electrode material is reduced, and for a specified service lifetime of the electrodes, the amount of electrode material in an electrode can be reduced. However, a corresponding reduction of the dimensions of the electrode, that is a reduction of that portion of the surface of the active part of the electrode which is in electric contact with the surrounding conducting medium, will increase the resistance of the electrode and in certain cases, with a specified service life time and a specified maximum resistance, the requirements would, for an substantially homogeneous electrode, lead to a design comprising an unnecessarily great amount of electrode material.

Figure 11C:
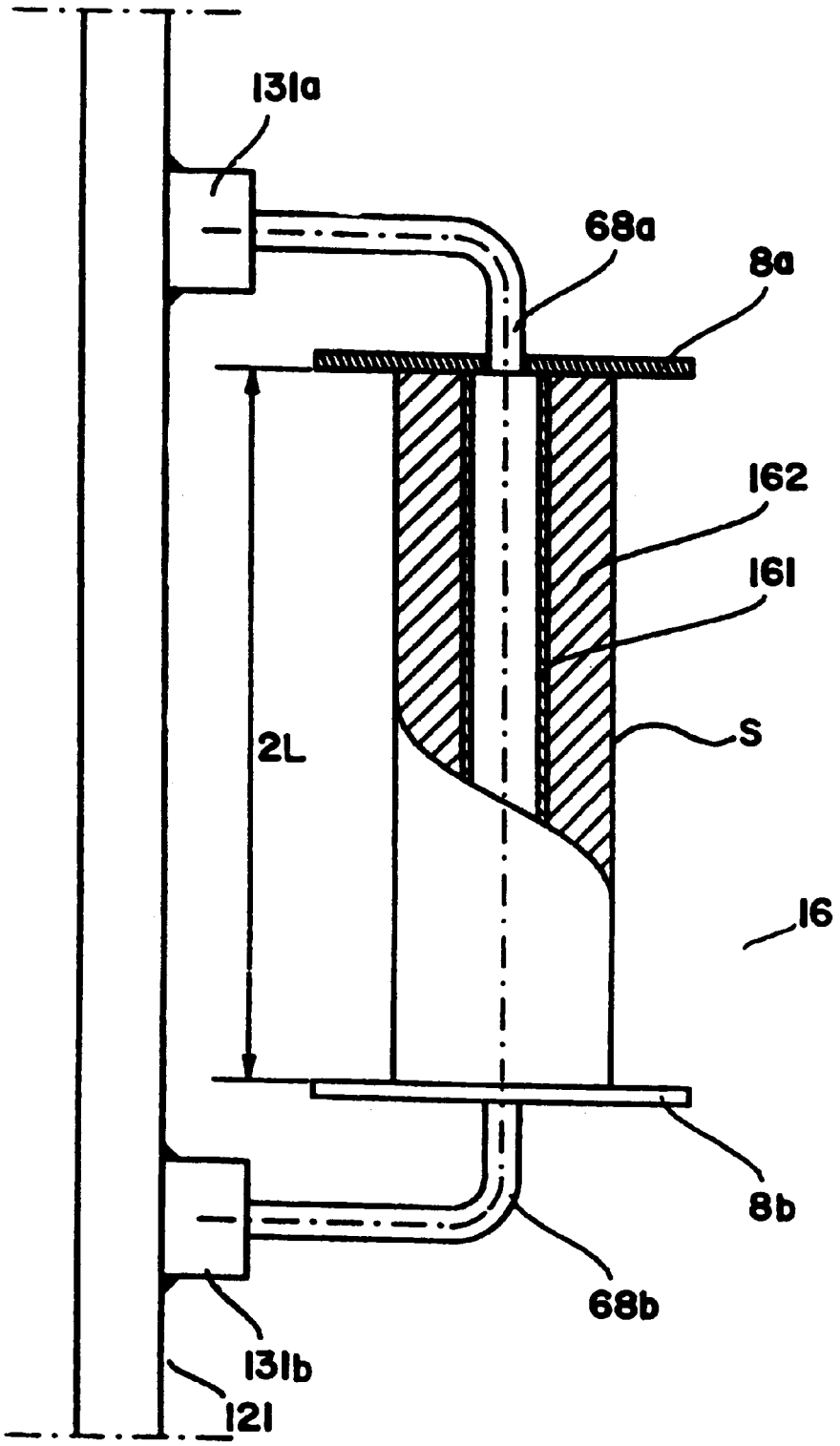
FIG. 11C shows a development of the embodiment of the invention according to FIG. 11B.

An advantageous development of the invention is illustrated in FIG. 11C. The figure shows in a cut-up view details of a cylinder-shaped electrode 16, operating as sacrificial anode. The electrode is attached to the inner surface of a water chamber 121 via connector bars 68*a*, 68*b* and attachment members 131*a*, 131*b* respectively, in a similar manner as described in connection with FIGS. 11A and 11B, and is provided with barriers 8*a*, 8*b* according to the invention. According to this development of the invention, the electrode is further provided with an insert member 161 with a cylindrical outer surface, preferably of tubular shape. The active part 162 of the electrode, comprising the electrode material, typically such as magnesium, zinc or aluminum, thus has the shape of a hollow cylinder arranged outside and surrounding the insert member. The insert member is manufactured of an electrically conductive material, typically steel or aluminum, and its outer surface is in electrical and mechanical contact with the inner surface of the active part of the electrode along the total length 2 L of the active part of the electrode. The insert member serves as a mechanical support for the active part of the electrode and also provides the electric connection between the active part of the electrode and the connector bars 68*a*, 68*b*, for example by being welded to these bars (not shown in the figure). The connector bars as well as the attachment members 131*a*, 131*b* are covered by a non-conductive layer (not shown in the figure) so as to prevent electric contact between the surrounding medium on one hand and the insert member, the connector bars and the attachment members on the other hand.

From a given a design criteria, specifying a certain minimum service life time and a certain maximum resistance of the electrode, the minimum required amount of electrode material and the dimensions of the electrode can be calculated in a per se known way for a chosen electrode material. In accordance with this development of the invention, the outer dimensions of the insert member, for example, when the insert member has the shape of a circular tube, its length and its outer diameter, are then selected in such a way that the active part of the electrode gets dimensions which fulfill the requirement on specified maximum resistance and, at the same time, contains only the minimum required amount of electrode material.

An insert member such as described in connection with FIG. 11C can also be applied to electrodes intended for use in systems working according to the ICCP principle.

Figure 12:
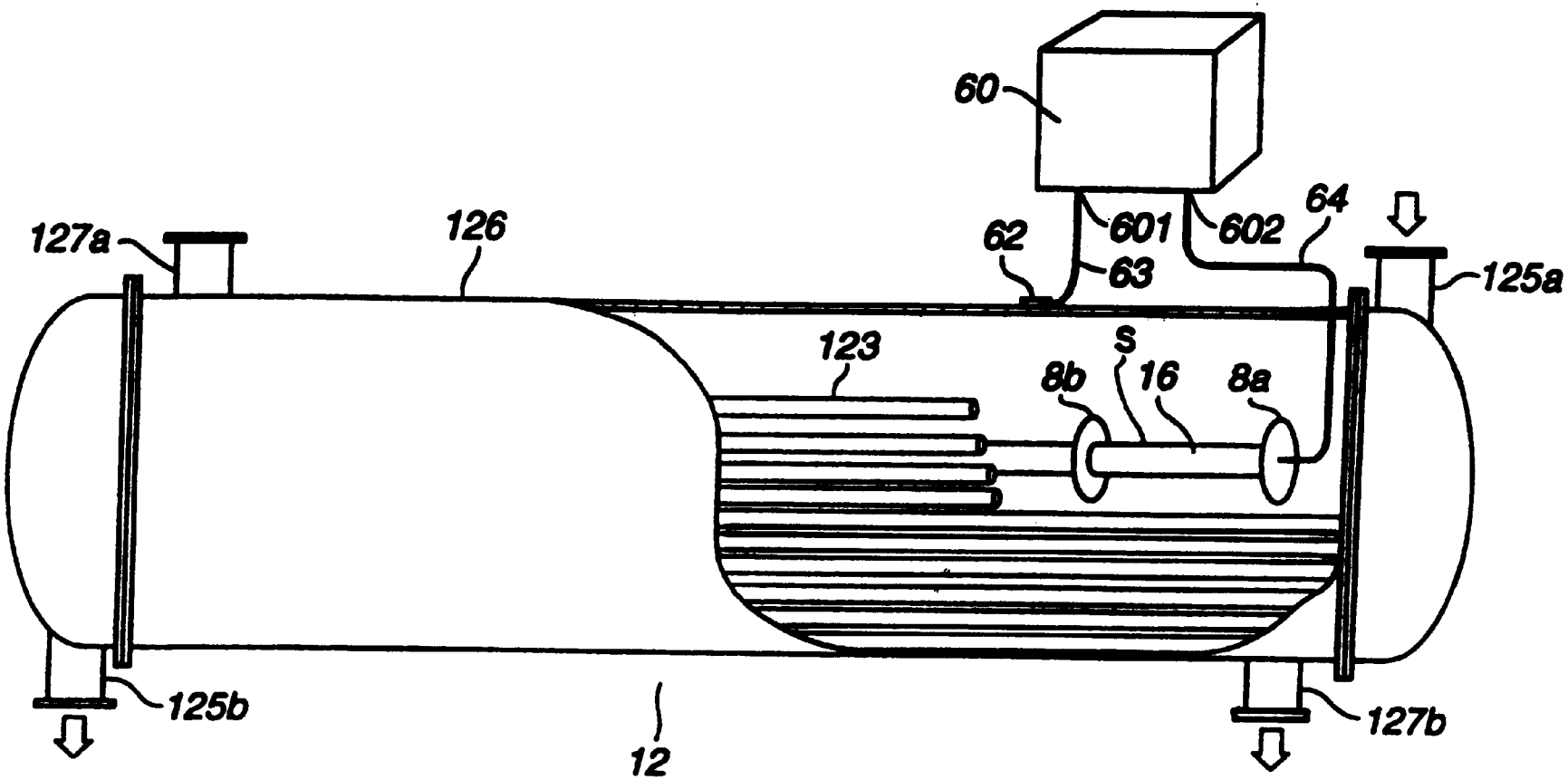
FIG. 12 shows a system for anodic corrosion protection of a heat exchanger, with electrodes according to the invention.

FIG. 12 shows schematically a heat exchanger 12. The heat exchanger is enclosed in a vessel 126 with an inlet 125*a* and an outlet 125*b* for a cooling medium. Inside the heat exchanger, the cooling medium is passed through a plurality of tubes 123 of a highly alloyed steel. The vessel is, in order to illustrate the invention, shown partly cut up. Through an inlet 127*a*, an acid liquid to be cooled passes into the vessel, surrounding the tubes 123, and leaves the vessel through an outlet 127*b*.

A power unit 60, supplied with electric power from an alternating current supply (not shown) delivers on its output terminals 601, 602 a DC current. The terminal 601 is, via a conductor 63, connected to the outer surface of the vessel 126 at a drainage point 62, and, via a feeder cable 64, to a an electrode 16, located inside the vessel. The electrode, which is of cylindrical shape and is oriented along the tubes 123, operates as a cathode for anodic protection of the tubes according to the impressed current principle as described above. The electrode is provided with barriers 8*a*, 8*b* according to the invention (two of which are shown in the figure) and it shall be understood that the electrode shown in the figure may be provided with a plurality of barriers, spaced along the electrode to provide an optimal homogenizing effect of the current distribution along the electrode. The barriers are shown as circular discs but their shape may also be adapted to configuration of the surroundings of the electrode. The heat exchanger may also, as the case may be, be equipped with one or more additional electrodes of similar kind as the one described above.

Figure 13A:
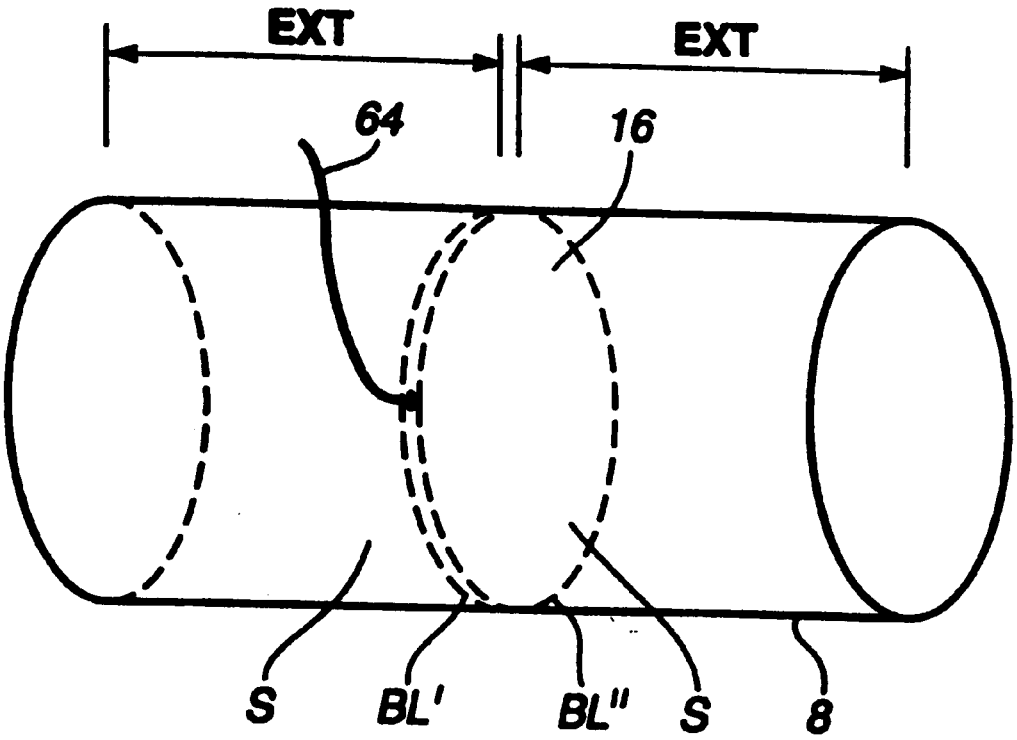
FIG. 13A shows schematically another embodiment of non-conducting barriers according to the invention.

An embodiment of the invention, advantageous in particular where the active part S of the surface of the electrode has a flat shape, is illustrated schematically in FIG. 13A. The electrode 16 has the shape of a straight circular cylinder with a longitudinal extension less than its diameter. Along its envelope surface a barrier 8 of a non-conducting material is arranged in such a way that it forms a tube completely enveloping the electrode. The electrode is fed at its envelope surface via an electrically insulated feeder cable 64, penetrating the barrier. The location of penetration is covered with a non-conducting material to ensure that all of the envelope surface of the electrode is covered by non-conducting material. The active part S of the surface of the electrode is both its cross section surfaces, that is its total surface less its envelope surface. The border lines BL', BL" are in this case the contour lines of the cross section surfaces of the cylinder, that is the two circles making up the circumferences of the cylinder at its both ends. The extension of the barrier from the active part of the surface of the electrode is indicated with the distance EXT in the figure, and by increasing the length EXT of the barrier in the longitudinal direction of the cylinder, the current distribution on the cross section areas of the electrode can be homogenized to any desired degree, in the theoretical limiting case of infinite length of the barrier, to be totally uniform.

In this embodiment of the invention, the contour of the electrode and the form of the tubular barrier, as seen from the active part of the surface of the electrode, both have the same form, that is in the embodiment illustrated in FIG. 13A, a circular form.

Figure 13B:
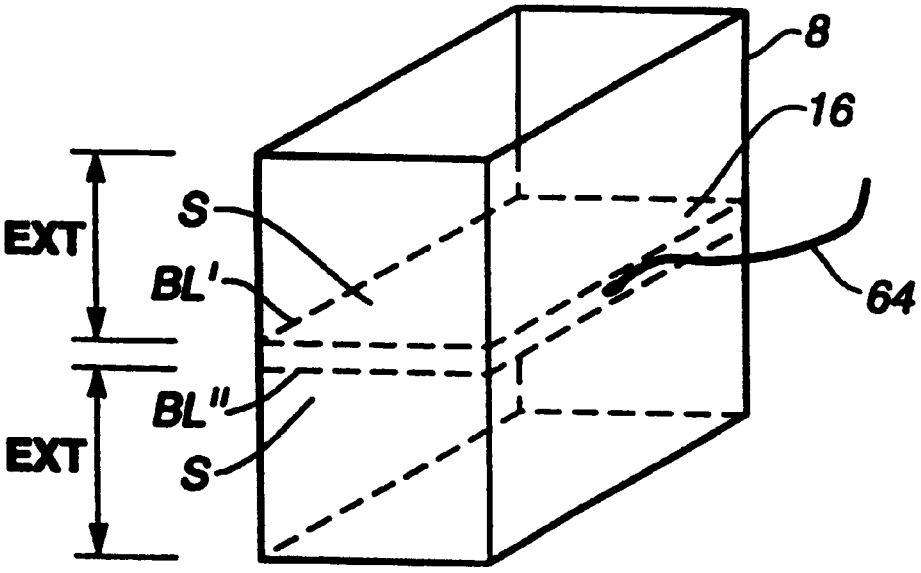
FIG. 13B shows schematically an embodiment of non-conducting barriers of the same kind as illustrated in FIG. 13A, with an electrode of a different shape.

However, the contour of the barrier is easily adapted to any shape of the contour of the electrode, one example of which is illustrated in FIG. 13B. The electrode 16 has the shape of a rectangular plate with a height less than its length and width, the length and width determining its flat surfaces. Along its side surface a barrier 8 of a non-conducting material is arranged in such a way that it forms a tube of rectangular shape completely enveloping the electrode. The electrode is fed at one of the side surfaces of the electrode in the same manner as described in connection with FIG. 13A. The active part S of the surface of the electrode is thus its total surface less all of its four side surfaces, that is both of its flat surfaces.

The following advantages are achieved by the invention.

With a more homogeneous current distribution along the active part of the electrode surface, the dissolution rate of the electrode material is reduced, thereby increasing the service lifetime of the electrodes and/or reducing the amount of electrode material needed for a specified service life time.

Figure 5:
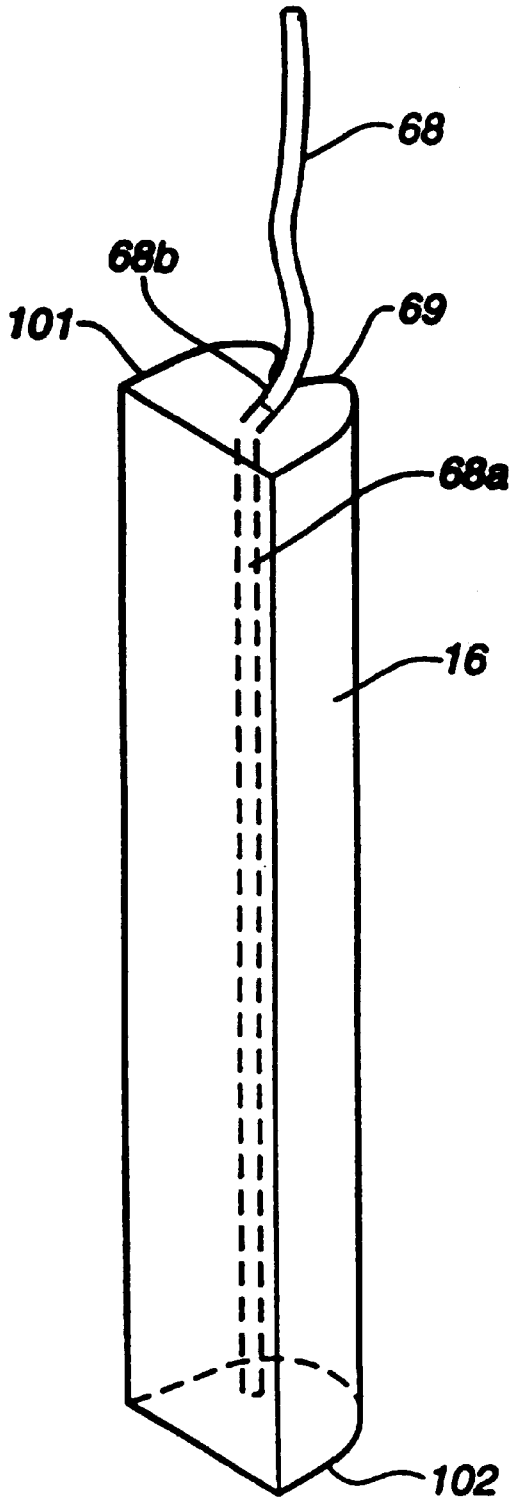
FIG. 5 (PRIOR ART)
FIG. 5 shows a prior art electrode for use as a sacrificial anode.

Sacrificial anodes as illustrated in FIG. 5 will operate with higher efficiency during their lifetime.

For cathodic protection systems operating according to the ICCP principle, for example on inner surfaces, the electrodes often are made of titanium or niobium, plated with a very thin layer of platinum or mixed metal oxides. Both types of plating imposes a maximum voltage on the anode in order to minimize the risk for break down of the plating (about 8.5 V for titanium and about 40 V for niobium). With a more homogeneous current distribution, a lower anode voltage can be used with the same or even increased efficiency at the same time as the risk for break down of the plating is reduced.

Accumulation of residual products due to anodic and cathodic reaction processes, for example on the inner surface of a pipeline at the attachment point of an electrode, which are due to high current densities at these points, can be reduced to lower levels.

We claim:

1. Electrode for use in electrochemical corrosion protection systems, comprising at least two electrically non-conducting barriers, spaced apart along the electrode, and between which is formed an active part of the surface of the electrode, which active part is to be put in electric contact with an ionically conducting medium, wherein at least one of said barriers has the shape of a plate projecting from said active part, and said barriers have a substantial extension outwards from said active part of the surface of the electrode, so as to have a substantial extension into said conducting medium when said active part is put in electric contact with said conducting medium, thereby to homogenize the current distribution along said active part of the surface of the electrode.

2. Electrode according to claim 1, wherein the electrode is an electrode in an electro-chemical corrosion protection system operating according to the impressed current principle.

3. Electrode according to claim 1, wherein the electrode is a sacrificial anode in a cathodic corrosion protection system operating according to the principle of sacrificial anodes.

4. Electrode according to claim 1, wherein said electrically non-conducting barriers project from the surface of the electrode at or close to border lines of said active part of the surface of the electrode, in directions, which, at that location, are substantially perpendicular to said active part of the surface of the electrode.

5. Electrode according to claim 1, wherein the electrode has the shape of a rod, and at least one of the barriers has the shape of a plate, projecting from the envelope surface of the electrode in a direction substantially perpendicular to the longitudinal direction of the electrode.

6. Electrode according to claim 1, wherein the at least two non-conducting barriers also act as a support for the electrode.

7. Electrode according to claim 1, for use as an anode in a system for cathodic protection against corrosion of an inner surface of a metallic structure and is attached to said inner surface, wherein the electrode comprises means for providing an electric isolation of the electrode from the medium, along its extension between the inner surface of said structure and that barrier of the at least two barriers which is located adjacent to said inner surface.

8. Electrode according to claim 7, wherein the barriers are made of a flexible material.

9. Electrode according to claim 1, wherein the electrode has the shape of a rod, including a cylindrical metal tube, for example made of steel, which encloses the electrode so as to form together with the at least two end barriers a closed canister, containing the electrode and a backfill.

10. Electrode according to claim 1, including an active part in the shape of a hollow cylinder and an electrically conductive, substantially cylindrical and tubular insert member, the active part of the electrode being arranged outside and surrounding said insert member in such a way that the outer surface of said insert member is in electrical and mechanical contact with the inner surface of said active part of the electrode along the total length of said active part of the electrode.

11. Method for selecting the dimensions of an electrode according to claim 10, comprising the steps of calculating, from a design criteria specifying the expected service life time of the electrode and the maximum resistance of the electrode the minimum required amount of electrode material in said active part of the electrode and the outer dimensions of said active part of the electrode, selecting the outer dimensions of said insert member in such a way that said active part of the electrode, when containing only the minimum required amount of electrode material, will have outer dimensions such that said design criteria is fulfilled.

12. Electrode according to claim 1, wherein at least one of said barriers has the shape of a plate, projecting from said active part of the surface of the electrode, said plate exhibiting a convex surface towards said active part of the surface of the electrode.

13. Electrode for use in electro-chemical corrosion protection systems, of which an active part of its surface is to be put in electric contact with an ionically conducting medium, wherein the active part of the surface has a substantially flat shape, comprising an electrically non-conducting barrier of tubular shape, and wherein said non-conducting barrier at least close to a border line of the active part of the surface, projecting from the surface of the electrode in a direction which, at that location, is substantially perpendicular to the active part of the surface of the electrode, and having a substantial extension outwards from said active part of its surface so as to have a substantial extension into the conducting medium when said active part is put in electric contact with the conducting medium, thereby homogenizing the current distribution over the surface of the electrode.

14. Electrode for use in electro-chemical corrosion protection systems, wherein the electrode has the shape of a rod, comprising at least two plate-shaped electrically non-conducting barriers, spaced apart along the electrode, and between which is formed an active part of the surface of the electrode, which active part is to be put in electric contact with an ionically conducting medium, said barriers having substantially the same cross-section dimension as the cross-section dimension of the electrode, having the purpose to homogenize the current distribution along said active part of the surface of the electrode.

15. An electrode for use in electrochemical corrosion protection systems, comprising:

an electrode having an active surface contactable with an ionically conducting medium;

at least two electrically non-conducting barriers spaced apart along the electrode, the active surface formed between the barriers, the barriers substantially extending outwards from the active surface, at least one of the barriers being plate-shaped and extending from the active part, wherein current distribution along the active surface is homogenized by the barriers substantially extending outwards from the active surface.

16. An electrode according to claim 15, wherein one of the barriers is locatable adjacent an inner surface of an external structure, and the electrode further comprises electric isolation along its extension between the inner surface the barrier locatable adjacent the inner surface of the external structure.

17. An electrode according to claim 15, wherein the plate-shaped barrier extends from the electrode by a distance h and a separation distance on the electrode between the barriers is 2L, and the ratio h/L is greater than or equal to 0.1.

18. An electrode according to claim 17, wherein the ratio h/L is greater than or equal to 0.3.

* * * * *